US008699936B2

(12) United States Patent
Fujita

(10) Patent No.: US 8,699,936 B2
(45) Date of Patent: Apr. 15, 2014

(54) IMAGE FORMING APPARATUS

(75) Inventor: Takashi Fujita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 122 days.

(21) Appl. No.: 12/974,318

(22) Filed: Dec. 21, 2010

(65) Prior Publication Data

US 2011/0158724 A1 Jun. 30, 2011

(30) Foreign Application Priority Data

Dec. 28, 2009 (JP) ..... 2009-298431

(51) Int. Cl.
*G03G 15/00* (2006.01)

(52) U.S. Cl.
USPC ..... 399/395; 399/394; 399/396; 271/225; 271/226; 271/227; 400/630; 400/632; 400/632.1; 400/633

(58) Field of Classification Search
USPC ..... 399/394, 395, 396; 271/225, 226, 227; 400/630, 632, 632.1, 633
See application file for complete search history.

(56) References Cited

U.S. PATENT DOCUMENTS

| | | | | |
|---|---|---|---|---|
| 4,438,918 | A * | 3/1984 | Ito et al. | 271/251 |
| 4,971,304 | A | 11/1990 | Lofthus | |
| 5,984,302 | A * | 11/1999 | Garrone | 271/227 |
| 6,055,407 | A * | 4/2000 | Inoue et al. | 399/381 |
| 6,059,284 | A * | 5/2000 | Wolf et al. | 271/227 |
| 6,102,391 | A * | 8/2000 | Malick et al. | 271/225 |
| 6,272,307 | B1 | 8/2001 | Ishizuka et al. | |
| 6,409,043 | B1 | 6/2002 | Fujita et al. | |
| 6,487,381 | B1 | 11/2002 | Ishizuka et al. | |
| 6,691,399 | B1 | 2/2004 | Hayashi et al. | |
| 6,771,928 | B2 | 8/2004 | Fujita | |
| 7,127,186 | B2 | 10/2006 | Fujita et al. | |

(Continued)

FOREIGN PATENT DOCUMENTS

| | | | |
|---|---|---|---|
| CN | 1881096 | A | 12/2006 |
| JP | 09-048540 | A | 2/1997 |

(Continued)

OTHER PUBLICATIONS

Notification of First Office Action dated Apr. 18, 2013, issued by the State Intellectual Property Office of P.R. China, in Chinese Application No. 201010622953.3.

*Primary Examiner* — Matthew G Marini
*Assistant Examiner* — Allister Primo
(74) *Attorney, Agent, or Firm* — Fitzpatrick, Cella, Harper & Scinto

(57) ABSTRACT

According to the present invention, skew feeding of a sheet is corrected while conveying the sheet, positioning of a side edge of the sheet in the width direction is carried out, and an image is formed on the sheet by an image forming portion 90. Two steering mechanisms 120*a* and 120*b* are disposed upstream of the image forming portion along the conveying direction, and the steering mechanisms 120*a* and 120*b* can feed a sheet on the skew in any direction with respect to the sheet conveying direction. Two CISs 100*a* and 100*b* are disposed along the sheet conveying direction corresponding to the steering mechanisms. A skew feeding angle and a skew feeding velocity of each of the steering mechanisms is changed according to differential value between a side edge position detected by the CISs 100*a* and 100*b* and a target position of a side edge of a sheet.

8 Claims, 20 Drawing Sheets

(56) References Cited

U.S. PATENT DOCUMENTS

| | | | | |
|---|---|---|---|---|
| 7,549,629 | B2 | 6/2009 | Tateishi et al. | |
| 7,658,379 | B2 | 2/2010 | Yasumoto | |
| 7,748,697 | B2 * | 7/2010 | Fujita et al. | 271/91 |
| 8,123,218 | B2 | 2/2012 | Yasumoto | |
| 2006/0197038 | A1 | 9/2006 | Park | |
| 2009/0091075 | A1 | 4/2009 | Yasumoto | |
| 2010/0102504 | A1 | 4/2010 | Yasumoto | |
| 2011/0156341 | A1 | 6/2011 | Fujita | |

FOREIGN PATENT DOCUMENTS

| | | | |
|---|---|---|---|
| JP | 10-310289 | | 11/1998 |
| JP | 2002087643 | A | 3/2002 |
| JP | 2008030883 | A | 2/2008 |
| JP | 2009091095 | A | 4/2009 |
| JP | 5078532 | B2 | 11/2012 |

* cited by examiner

IMAGE FORMING APPARATUS

BACKGROUND OF THE INVENTION

1. Field of the Invention

The present invention relates to an image forming apparatus such as a copying machine, a printer and a facsimile machine, and more particularly, to an image forming apparatus which corrects skew feeding of a sheet while conveying the sheet, and which conducts positioning of a side edge (end) of the sheet in a width direction intersecting with a sheet conveying direction.

2. Description of Related Art

Generally, image forming apparatuses of an electrophotographic system, an offset printing system and an ink-jet system are known. As image forming apparatuses using the electrophotographic system, image forming apparatuses of various systems are known, such as an image forming apparatus of a direct transfer system which transfers a toner image from a photosensitive drum directly to a sheet, and an image forming apparatus of an intermediate transfer system which once transfers a toner image to an intermediate transfer member and then transfers the toner image to a sheet. As image forming apparatuses using the electrophotographic system, an image forming apparatus of a tandem system in which a plurality of image forming portions is arranged, and an image forming apparatus of a rotary system in which a plurality of image forming portions is cylindrically arranged are known.

In recent years, in image forming apparatuses of the electrophotographic system, making full use of a merit that a plate is not formed, apparatuses targeting a printing market of small copies are provided. In order to be accepted by such a light printing market, high velocity (high productivity) and high image quality must be achieved in various kinds of materials, and a requirement for sheet conveying precision is increased. An image position precision with respect to a sheet is most required to be high, an image position deviation of front and back when images are formed on both surfaces is also included. There is a method for adjusting a position of an image with respect to a sheet, but a method for adjusting a sheet with respect to an image predominates.

The precision of an image position is determined by registration of a sheet in a sheet conveying direction, registration of a sheet in a width direction intersecting with the sheet conveying direction, magnification and skew feeding. Among them, it is difficult to correct the skew feeding of a sheet by electrical control. For example, if skew feeding of a sheet is detected and an image which inclines corresponding to the skew feeding is formed, it is possible to correct an image position with respect to the sheet. However, in the case of a color image on which three or four colors are superposed, if an image is inclined every sheet, color is changed in every sheet due to deviation of dot formation of each color. Further, since it takes time to calculate for inclination of an image, productivity is largely reduced. Thus, the skew feeding of a sheet is determined by performance of conveying precision of a sheet.

Generally, the skew feeding of a sheet and registration are independently controlled, but in recent years, there is proposed a method for correcting the skew feeding and correcting registration in a direction intersecting with the sheet conveying direction at the same time or by the same driving operation (see Japanese Patent Laid-Open No. 10-310289). More specifically, it includes two moving drive motors which independently slide two rollers arranged in the sheet conveying direction in a direction intersecting with the sheet conveying direction, and two optical sensors which detect a side edge (end) of a sheet are arranged in the sheet conveying direction corresponding to the roller. Control is carried out such that the rollers are slid in the width direction so that the side edge of the sheet follows the optical sensor.

According to the conventional method, however, since the rollers are slid in the direction intersecting with the sheet conveying direction to correct the skew feeding of the sheet or correct the position of the sheet in the width direction, stress is applied to the sheet when the rollers slide. Especially, in the case of a thin paper sheet, since a sheet is bent between the two rollers, it is difficult to precisely correct the skew feeding of a sheet or correct a position of a sheet in the width direction.

According to the conventional method, since the moving drive motor is rotated normally and reversely by an ON/OFF operation of the optical sensor, a sheet overshoots in the width direction and reciprocates, and it takes time for a side edge of the sheet to reach a target position. If an attempt is made to enhance the position precision of an image with respect to a sheet, the conveying velocity of the sheet cannot be increased, and the productivity cannot be enhanced.

Hence, the present invention provides an image forming apparatus which can handle various kinds of materials including a sheet having weak elasticity such as a thin paper sheet, and which has excellent position precision of an image with respect to a sheet, and which enhances the productivity.

SUMMARY OF THE INVENTION

The present invention provides an image forming apparatus arranged to carry out position adjustment, of a side edge of a sheet, in a width direction intersecting with a sheet conveying direction, while conveying the sheet, and wherein the image forming apparatus comprises an image forming portion arranged to form an image on the sheet, the image forming apparatus further comprising: a plurality of conveying portions positioned upstream of the image forming portion in the sheet conveying direction and spaced from each other along the conveying direction, wherein each conveying portion is operable to vary its conveying angle and conveying velocity to adjust the skew of the conveyed sheet in a plurality of directions with respect to the sheet conveying direction; a plurality of side edge position detectors each in a position corresponding to one of the conveying portions and arranged to respectively detect a side edge position of the sheet in the width direction; and a controlling portion arranged to obtain a differential value between the side edge position detected by the side edge position detector and a target position of the side edge of the sheet for each of the conveying portions, and arranged to control the conveying angle and the conveying velocity of each conveying portion according to the differential value.

According to the present invention, since the skew feeding angle and the skew feeding velocity of a sheet are changed by each conveying portion according to each obtained differential value, bending of the sheet is suppressed, application of stress on the sheet is suppressed, and it is possible to correct the skew feeding of the sheet and carry out the positioning of the side edge of the sheet. It is possible to precisely correct the skew feeding of a sheet, and precisely carry out the positioning of the side edge of the sheet with respect to various kinds of materials including a thin paper sheet. Since the differential value is obtained and the skew feeding angle and the skew feeding velocity of each conveying portion are changed, it is possible to swiftly bring the side edge of the sheet to a target position. Therefore, it is possible to enhance the position precision of an image with respect to a sheet, to enhance the conveying velocity of a sheet, and to enhance the productivity.

Further features of the present invention will become apparent from the following description of exemplary embodiments with reference to the attached drawings.

DESCRIPTION OF THE EMBODIMENTS

Embodiments for carrying out the present invention will be described in detail with reference to the drawings.

First Embodiment

Figure 1:
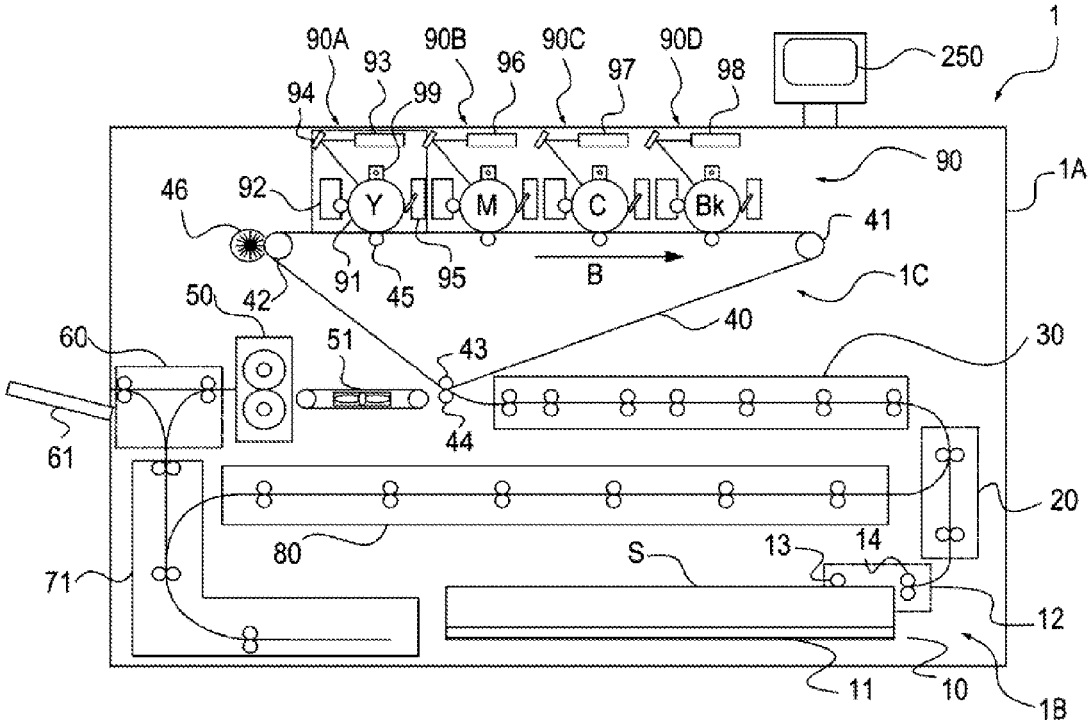
FIG. 1 is a diagram illustrating an outline configuration of a color image forming apparatus as one example of an image forming apparatus according to a first embodiment of the present invention.

FIG. 1 is a diagram illustrating an outline configuration of a color image forming apparatus as one example of an image forming apparatus according to a first embodiment of the present invention. In FIG. 1, the color image forming apparatus as an image forming apparatus 1, includes an image forming apparatus body (apparatus body, hereinafter) 1A. The apparatus body 1A includes image forming portions 90 which form an image on a sheet S, a sheet feeding apparatus 1B which feeds sheets S, and a registration unit 30 as a sheet conveying apparatus which conveys a sheet S fed by the sheet feeding apparatus 1B to the image forming portion 90. An operation portion 250 through which a user carries out various input/setting with respect to the apparatus body 1A is connected to an upper surface of the apparatus body 1A.

The image forming portion 90 includes image forming units 90A to 90D of yellow (Y), magenta (M), cyan (C) and black (Bk), and a transfer portion 1C. Each of the image forming units 90A to 90D includes a photosensitive drum 91, an exposing apparatus 93, a development device 92, a primary transfer roller 45, a photoreceptor cleaner 95 and a charger 99. Colors formed by the image forming units 90A to 90D are not limited to these four colors, and alignment sequence of colors is not limited.

The transfer portion 1C transfers a toner image to a conveyed sheet S. The transfer portion 1C includes an intermediate transfer belt 40 which is wound around rollers such as a drive roller 42, a tension roller 41, a secondary transfer inner roller 43, and which is conveyed and driven in a direction of arrow B in the drawing. A toner image formed on the photosensitive drum is transferred to the intermediate transfer belt 40 by a predetermined pressure force given by the primary transfer roller 45 and electrostatic load bias. The secondary transfer inner roller 43 and a secondary transfer outer roller 44 are substantially opposed to each other, and a non-fixed image is adsorbed to a sheet S by giving a predetermined pressure force and an electrostatic load bias in a secondary transfer portion formed by the secondary transfer inner roller 43 and the secondary transfer outer roller 44.

The sheet feeding apparatus 1B includes a sheet accommodating portion 10 which can be pulled out by a slide rail (not illustrated) with respect to the apparatus body 1A, and a sheet feeding portion 12 which sends out a sheet S accommodated in the sheet accommodating portion 10. The sheet accommodating portion 10 includes a sheet feeding lifter plate 11 which pushes a loaded sheet S against the sheet feeding portion 12. A configuration which picks up the uppermost sheet by the sheet feeding portion 12 and sends the sheet toward downstream is employed as the sheet feeding apparatus 1B, but it is also possible to employ an air sheet feeding system which sucks a sheet by air and sends the sheet. The sheet feeding portion 12 includes a sheet feeding roller 13, the sheet feeding roller 13 picks the uppermost sheet S and feeds the sheets S one sheet by one sheet. When a plurality of sheets S is picked up at the same time, a pair of separation conveying rollers 14 separates the sheets one sheet by one sheet and conveys the sheets.

In the image forming apparatus 1 having such a configuration, when an image is formed, a surface of the photosensitive drum 91 is previously uniformly electrified by the charger 99. Thereafter, the exposing apparatus 93 emits light to the photosensitive drum 91 which rotates in a counterclockwise direction based on a sent signal of image information, a surface of the photosensitive drum is irradiated with this light through a reflection portion 94 or the like, and a latent image is formed. Transfer remaining toner which slightly remains on the photosensitive drum 91 is collected by the photoreceptor cleaner 95, and the toner is used for a next image forming operation.

Next, the development device 92 develops toner with respect to an electrostatic latent image formed on the photosensitive drum 91 in this manner, and a toner image is formed on the photosensitive drum. Thereafter, a predetermined pressure force and electrostatic load bias are given by the primary transfer roller 45, and the toner image on the photosensitive drum is transferred to the intermediate transfer belt 40. An image is formed by the image forming units 90A to 90D of Y, M, C and Bk of the image forming portion 90 when the image is superposed on an upstream toner image which was primarily transferred to the intermediate transfer belt 40. As a result, a full color toner image is formed on the intermediate transfer belt 40 eventually.

A sheet S is sent out from the sheet accommodating portion 10 by the sheet feeding portion 12 with image forming timing of the image forming portion 90 and then, the sheet S passes through the conveying unit 20 and is conveyed to the registration unit 30. Correction of skew feeding of a sheet S and positioning of a side end of the sheet S in the width direction are carried out in the registration unit 30 and then, the sheet S is conveyed to the secondary transfer portion formed by the substantially opposed secondary transfer inner roller 43 and secondary transfer outer roller 44. Thereafter, a predetermined pressure force and electrostatic load bias in the secondary transfer portion, and a full color toner image is secondarily transferred to the sheet S.

Next, the sheet S to which the toner image is secondarily transferred is conveyed to the f50 by a pre-fixing conveying portion 51. In a fixing apparatus 50, a predetermined pressing force is applied by substantially opposed rollers or a belt, and a heating effect is added by a heat source such as a heater, and toner is melted and fixed to the sheet S.

Next, the sheet S having the fixed image obtained in this manner is discharged onto a discharge tray 61 as it is by a branch conveying apparatus 60. When images are to be formed on both surfaces of a sheet S, a switchable conveying path switching member (not shown) switches conveying paths and the sheet S is conveyed to a branch conveying apparatus 71. Then, the sheet S is conveyed to a reverse conveying apparatus 80 which constitutes the re-conveying portion by a branch conveying apparatus 71.

If the sheet S is conveyed to the reverse conveying apparatus 80, then, the sheet S merges with a sheet of subsequent job conveyed from the sheet feeding apparatus 1B at the conveying unit 20 in timing with the subsequent job sheet, and the sheet S is sent to the secondary transfer portion. Since the image forming process is the same as that of the first surface, description thereof is omitted. A toner image is transferred to a back surface of the sheet S in the secondary transfer portion and then, the toner image is fixed. After the toner image is fixed in this manner, the sheet S is discharged outside of the apparatus body 1A, and loaded on the discharge tray 61.

Figure 2A:
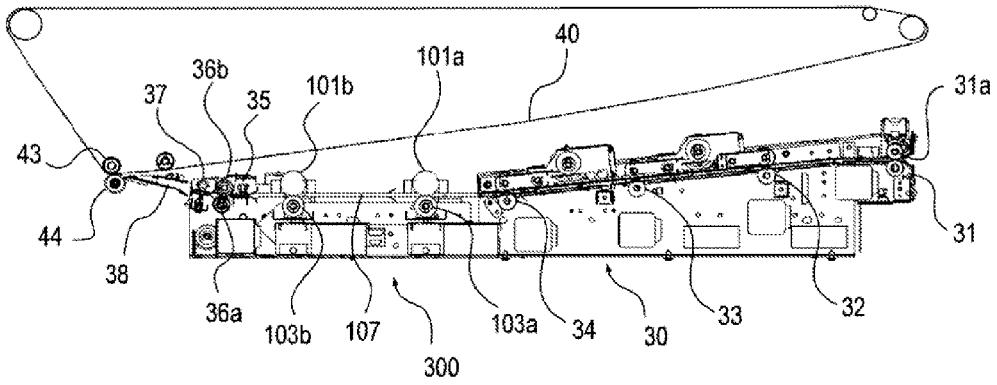
FIG. 2A is a front view of a registration unit.
Figure 2B:
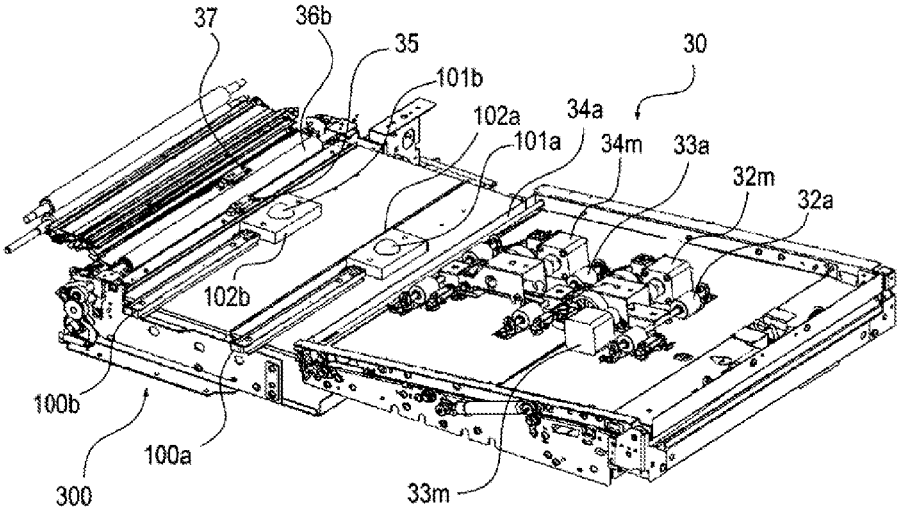
FIG. 2B is a perspective view of the registration unit.

Next, the registration unit 30 will be described in detail. As illustrated in FIGS. 2A and 2B, the registration unit 30 includes conveying rollers 31, 32, 33 and 34 sequentially disposed from upstream to downstream in a sheet conveying direction (conveying direction, hereinafter). The registration unit 30 includes a sheet attitude correcting portion 300 disposed downstream of the conveying roller 34 in the conveying direction. The conveying rollers 31, 32, 33 and 34 are rotated and driven by a driving source (not illustrated). Idler rollers 31*a*, 32*a*, 33*a* and 34*a* which are respectively opposed to the conveying rollers 31, 32, 33 and 34 are disposed above the conveying rollers 31, 32, 33 and 34. Pressure releasing motors 32*m*, 33*m* and 34*m* are connected to the idler rollers 32*a*, 33*a* and 34*a* through links (not illustrated), and the idler rollers 32*a*, 33*a* and 34*a* can be connected to and separated from the conveying rollers 32, 33 and 34.

A sheet detecting sensor 35 as a sheet detector, a pair of registration rollers 36*a* and 36*b*, and a sheet detecting sensor 37 are sequentially disposed between the sheet position correcting portion 300 and a pair of rollers 43 and 44 of the transfer portion 1C of the image forming portion 90. The pair of registration rollers 36*a* and 36*b* is a registration drive roller 36*a* and a registration follower roller 36*b*, respectively.

Figure 3A:
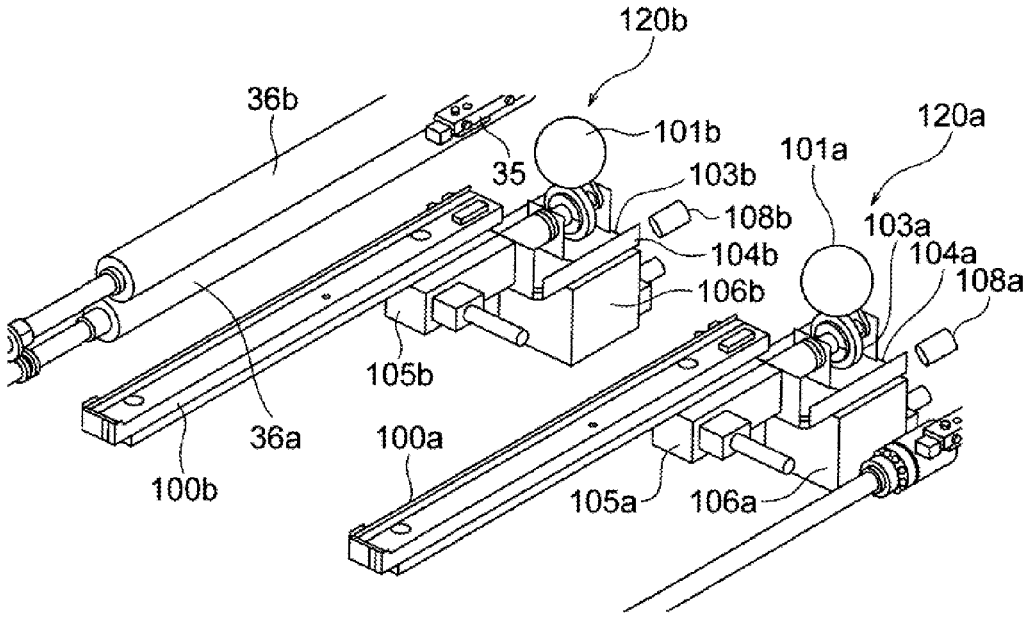
FIG. 3A is a perspective view illustrating an essential portion of a sheet position (attitude) correcting portion.
Figure 3B:
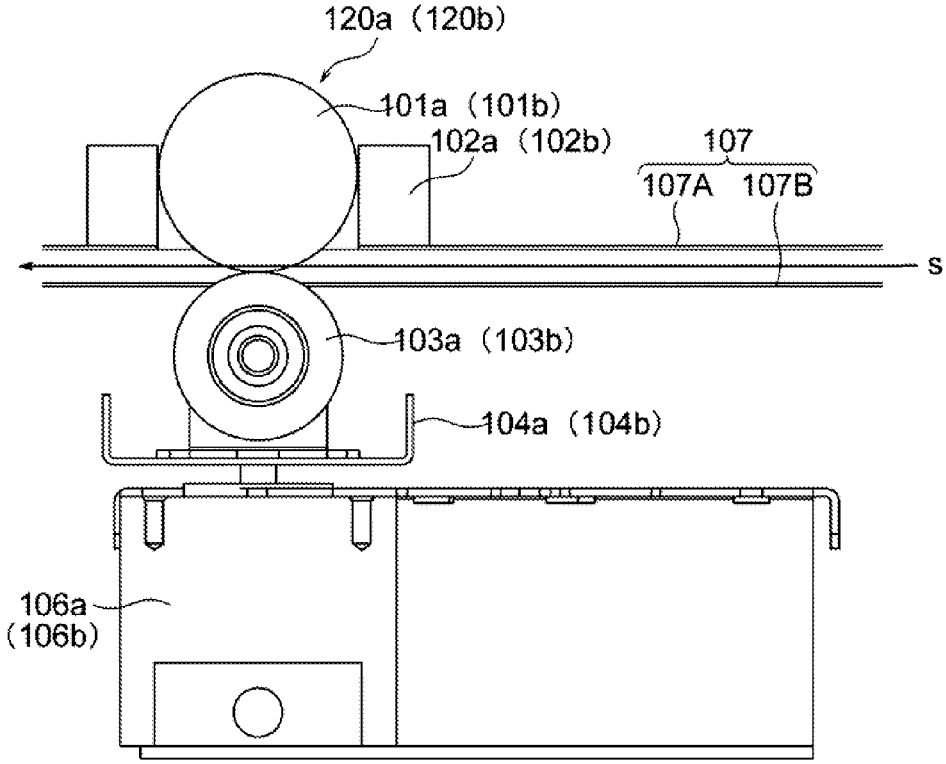
FIG. 3B is an explanatory diagram illustrating a steering mechanism.

Next, the sheet position correcting portion 300 will be described in detail. As illustrated in FIGS. 3A and 3B, the sheet position correcting portion 300 includes two steering mechanisms 120*a* and 120*b* as two conveying portions. The steering mechanisms 120*a* and 120*b* can feed sheets S on the skew in any direction with respect to the conveying direction, and disposed along the conveying direction upstream of the image forming portion 90 in the sheet conveying direction. The steering mechanism 120*a* and the steering mechanism 120*b* are formed from similar members.

The sheet position correcting portion 300 includes contact image sensors (CIS, hereinafter) 100*a* and 100*b* which are line sensors as two side edge (end) position detectors which detect one side edge (end) position of a sheet in the width direction intersecting with the conveying direction. The CISs 100*a* and 100*b* are disposed along the conveying direction corresponding to the steering mechanisms 120*a* and 120*b*.

The steering mechanisms 120*a* and 120*b* include steering rollers 103*a* and 103*b* as conveying rotating members turnably supported in a horizontal plane with respect to the conveying direction of a sheet. The steering mechanisms 120*a* and 120*b* also include spherical follower balls 101*a* and 101*b* which are disposed above the steering rollers 103*a* and 103*b* and which press the steering rollers 103*a* and 103*b* and follow the steering rollers 103*a* and 103*b* as a follower rotating member. The steering rollers 103*a* and 103*b* and the follower balls 101*a* and 101*b* nip a sheet S and convey the sheet.

The steering rollers 103*a* and 103*b* are rubber rollers, and disposed at central positions of the apparatus body 1A in the width direction. Although the steering rollers 103*a* and 103*b* are disposed at the central positions, if they can convey a sheet, they need not be disposed at the central position. The steering rollers 103*a* and 103*b* rotatably support stages 104*a* and 104*b* provided below a lower one (107B) of a pair of conveying guides 107. The stages 104*a* and 104*b* are turnably fixed to shafts of steering motors 106*a* and 106*b*. Conveying motors 105*a* and 105*b* which rotate and drive the steering rollers 103*a* and 103*b* are fixed to the stages 104*a* and 104*b*. Therefore, by rotating the steering motors 106*a* and 106*b*, the steering rollers 103*a* and 103*b* integrally turn together with the stages 104*a* and 104*b* and the conveying motors 105*a* and 105*b*. Stage home position sensors 108*a* and 108*b* are provided near the stages 104*a* and 104*b*. The stage home position sensors 108*a* and 108*b* define a state where the steering rollers 103*a* and 103*b* are in parallel to the conveying direction (a state where a conveying direction-angle is 0°) as a reference position, and detect whether the stages 104*a* and 104*b* are located at the reference position.

The follower balls 101*a* and 101*b* are metal spheres. The follower balls 101*a* and 101*b* are vertically movably supported by ball guides 102*a* and 102*b* provided above an upper one (107A) of the pair of conveying guides 107. More specifically, the follower balls 101*a* and 101*b* are vertically movably inserted into holes of the ball guides 102*a* and 102*b*. The follower balls 101*a* and 101*b* press the steering rollers 103*a* and 103*b* by their own weights. Since the follower balls 101*a* and 101*b* have the spherical shapes, even if conveying vectors of the steering rollers 103*a* and 103*b* are changed, the follower balls 101*a* and 101*b* can follow and rotate.

Centers of the shafts of the steering motors 106*a* and 106*b* and nip centers of the steering rollers 103*a* and 103*b* and the follower balls 101*a* and 101*b* are coaxially set, and the steering rollers 103*a* and 103*b* can turn around the nip centers. The CISs 100*a* and 100*b* are provided on the upper one (107A) of the pair of conveying guides 107, and the CISs 100*a* and 100*b* are disposed on nip center lines of the steering rollers 103*a* and 103*b* and the follower balls 101*a* and 101*b* which extend in the width direction. It is preferable the CISs 100*a* and 100*b* are disposed on the nip lines, but the invention is not limited to this. The pair of conveying guides 107 is black plated, and the CISs 100*a* and 100*b* detect a boundary of a lightness difference between a sheet S and the pair of conveying guides 107, thereby detecting a side edge position of the sheet S.

The conveying motors 105*a* and 105*b* and the steering motors 106*a* and 106*b* are stepping motors, and rotating velocities and angles of the steering rollers 103*a* and 103*b* can be set arbitrarily.

The sheet detecting sensor 35 detects whether there is a sheet. The sheet detecting sensor 35 is disposed between the image forming portion 90 and the steering mechanism 120*b* disposed on the most downstream side in the conveying direction, and more specifically, the sheet detecting sensor 35 is disposed between the steering mechanism 120*b* and the pair of registration rollers 36*a* and 36*b*. In other words, the sheet detecting sensor 35 is disposed immediately in front of the pair of registration rollers 36*a* and 36*b*.

Figure 4:
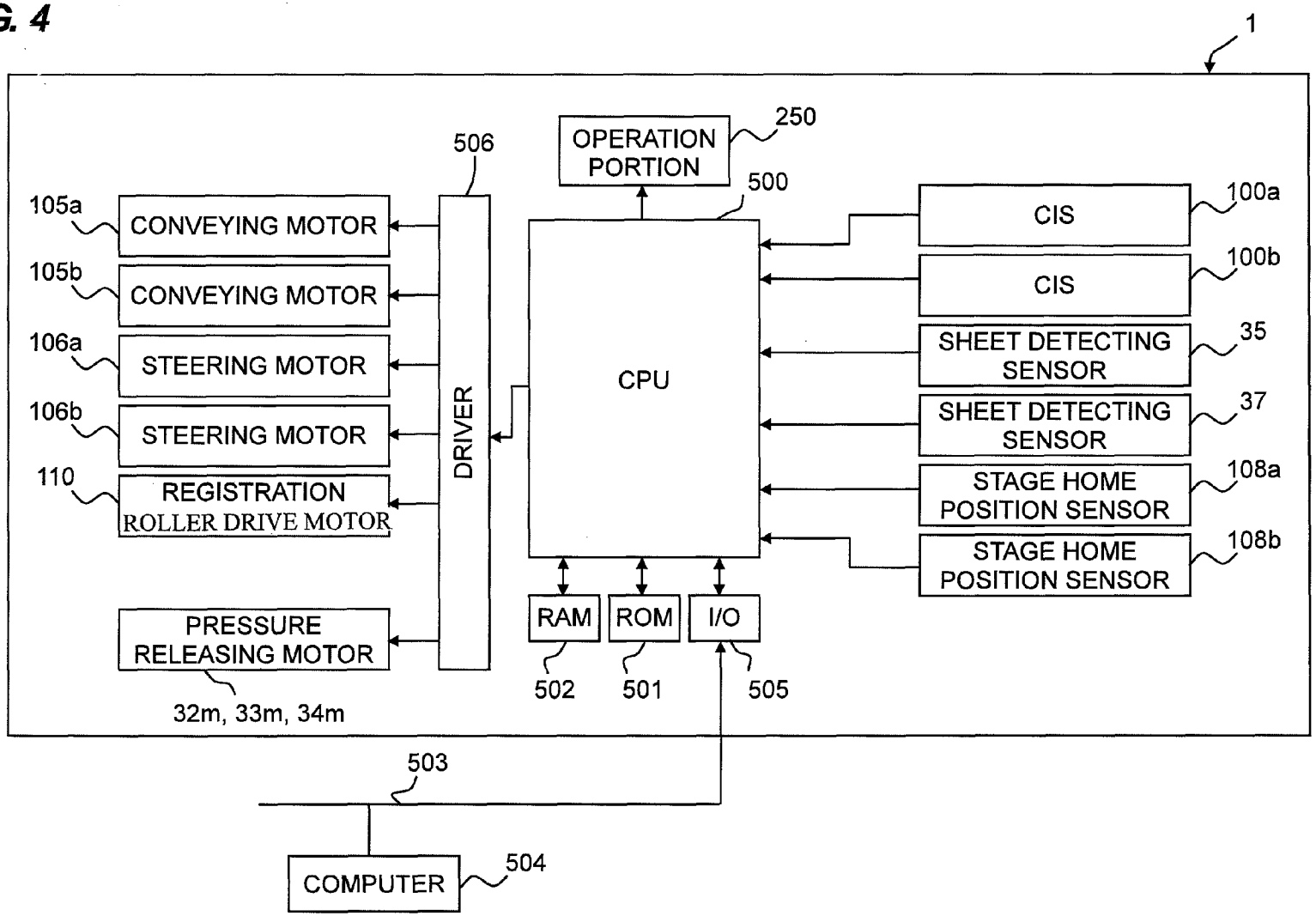
FIG. 4 is a block diagram illustrating a CPU of the image forming apparatus and a subject to be controlled.

As illustrated in FIG. 4, the image forming apparatus 1 includes a CPU 500 as a controlling portion which controls the entire apparatus, a ROM 501 in which a control program is stored, and a RAM 502 used as a working area. The image forming apparatus 1 includes an I/O 505 connected to a computer 504 through a network 503. The image forming apparatus 1 also includes a registration roller drive motor 110 which rotates and drives the registration drive roller 36*a*, in addition to the conveying motors 105*a* and 105*b*, the steering motors 106*a* and 106*b*, and the pressure releasing motors 32*m*, 33*m* and 34*m*. The CPU 500 outputs a command to a driver 506 and controls the motors based on information of the sensors, input information from the operation portion 250, and information which is input from the computer 504 through the I/O 505.

That is, the CPU 500 operates the steering motors 106*a* and 106*b* and turns the steering rollers 103*a* and 103*b* such that a sheet S is fed on the skew at a determined skew feeding angle. The CPU 500 operates the conveying motors 105*a* and 105*b* and rotates the steering rollers 103*a* and 103*b* such that a sheet S is fed on the skew at a determined skew feeding velocity. The CPU 500 selects pressing operations and pressing-releasing operations of the idler rollers 32*a*, 33*a* and 34*a*, and operates the pressure releasing motors 32*m*, 33*m* and 34*m*.

The CPU 500 adjusts a rotation velocity of the registration roller drive motor 110 to correct timing deviation with respect to a position of an image formed on the intermediate transfer belt 40 based on timing when the sheet detecting sensor 37 detects a leading edge (tip end) of a sheet S. The velocity is adjusted within a range in which the leading edge of the sheet S passes through the guide 38 (see FIG. 2A). By this control, an image and a position of a sheet S are precisely aligned with each other at the secondary transfer portion.

Figure 5:
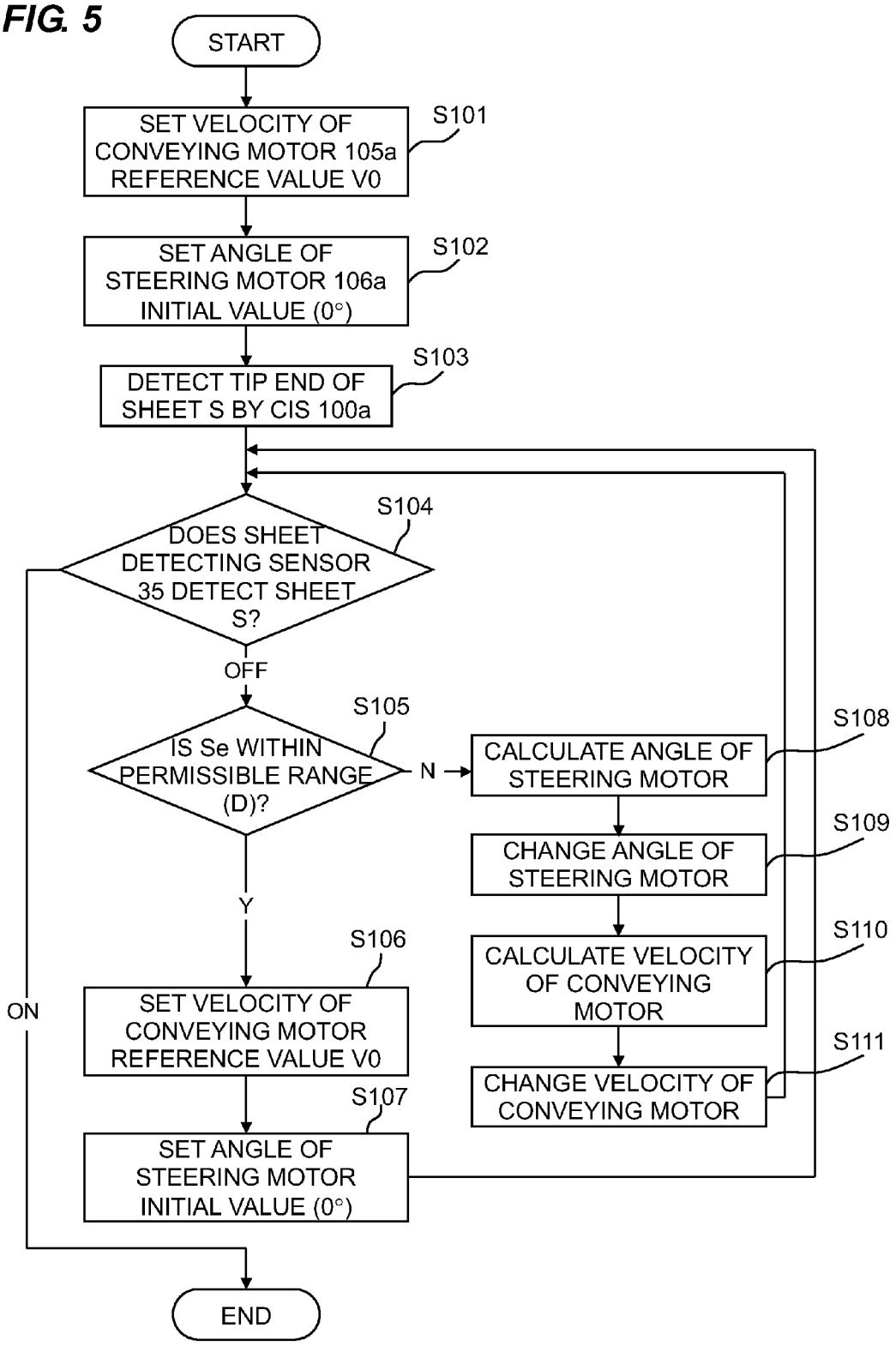
FIG. 5 is a flowchart of position (attitude) control of a sheet conducted by the CPU.
Figure 6:
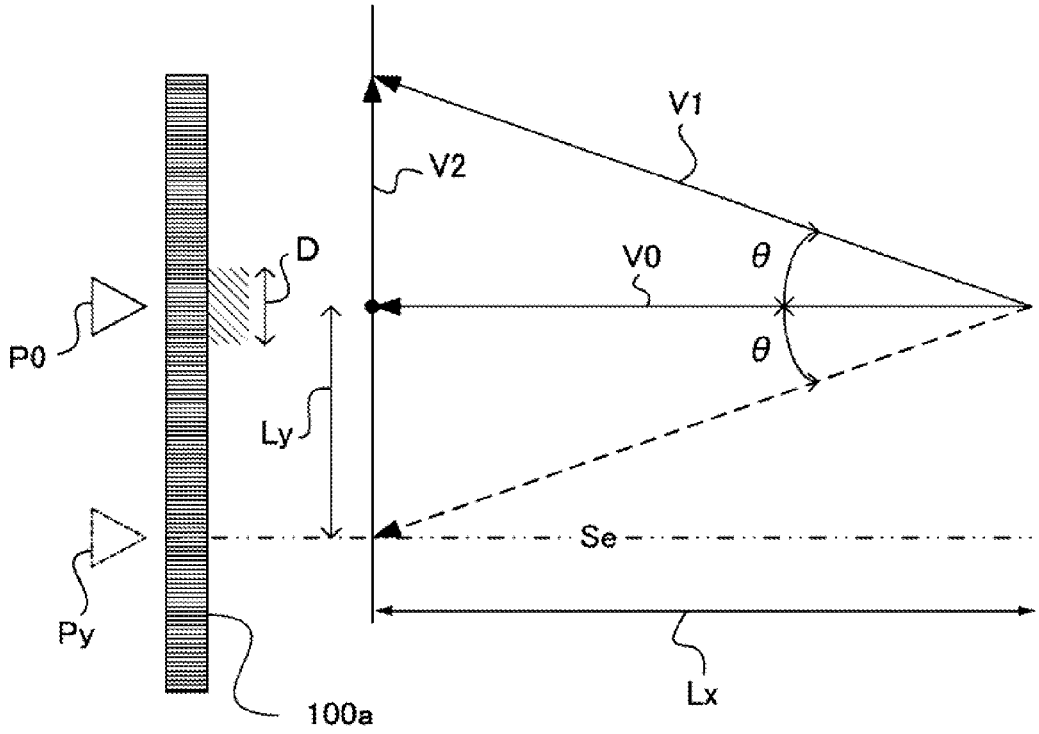
FIG. 6 is a diagram illustrating conception of calculation of correction control.

Next, a sequence of the sheet position correcting portion 300 will be described based on the flowchart in FIG. 5. Since the control of the steering mechanisms 120*a* and 120*b* is the same, operation of one (120*a*) of them will be described. FIG. 6 is a diagram illustrating conception of calculation of correction control.

When the apparatus body 1A is actuated, the CPU 500 sets a rotation velocity V1 of the conveying motor 105*a* to a reference value V0 (S101). A peripheral velocity of the steering roller 103*a* which is driven by the conveying motor 105*a* rotating at the reference value V0, i.e., a conveying velocity of a sheet S is the same velocity as an image forming velocity of the image forming portion 90. Next, the CPU 500 sets a turning angle θ of the steering motor 106*a* to an initial value 0° (S102). That is, the skew feeding angle of a sheet S with respect to the conveying direction is set to 0°. More specifically, by turning the stage 104*a* to a position detected by the stage home position sensor 108*a*, the turning angle θ of the steering motor 106*a* is set to 0° with respect to the conveying direction. According to this, the steering roller 103*a* is directed in parallel to the conveying direction. In steps S101 and S102, the sheet S is conveyed at the constant velocity same as the image forming velocity in the conveying direction. The turning angle θ of the steering motor 106*a* and the skew feeding angle of a sheet S are the same, and if the turning angle θ of the steering motor 106*a* is changed, the skew feeding angle of a sheet S is changed.

If a sheet S is sent from an upstream side in the conveying direction, since the CIS 100*a* detects a side edge position of the sheet S, the CPU 500 determines that a leading edge (tip end) of the sheet S is reached (so that the leading edge of the sheet has reached CIS 100*a*), and starts control of a position (S103). A sheet detecting sensor which determines that a leading edge (tip end) of a sheet S has reached it may be disposed independently from the CIS 100*a*. When the position is controlled, if rollers located upstream in the conveying direction nip a sheet S, acting as resistance and it becomes difficult to change the position of the sheet S, pressures of the idler rollers 32*a*, 33*a* and 34*a* are released by the pressure releasing motors 32*m*, 33*m* and 34*m*.

Next, the CPU 500 determines whether the sheet detecting sensor 35 which is disposed immediately in front of the registration drive roller 36*a* detects a sheet (S104). If the sheet detecting sensor 35 detects a sheet S (S104: ON), the position control is completed, and if the sheet detecting sensor 35 does not detect a sheet S (S104: OFF), the correcting control is continued.

Since a sheet S is conveyed in a skew feeding state or in a state where a position thereof in the width direction is deviated, the CPU 500 determines whether a position Py of a side edge Se of a sheet S detected by the CIS 100*a* is within a permissible range D including the target position P0 (S105). Here, the target position P0 of the side edge of the sheet is a value which is previously stored in a rewritable non-volatile memory such as the ROM 501 and an EEPROM. If it is determined that the position Py is within the permissible range D (S105: Yes), the steering motor 106*a* and the conveying motor 105*a* are brought back to their initial states. That is, the CPU 500 sets the rotation velocity V1 of the conveying motor 105*a* to the reference value V0 (S106), and sets the turning angle θ of the steering motor 106*a* to the initial value 0° (S107). According to this, a sheet S is conveyed in the conveying direction at a constant velocity that is the same as the image forming velocity. Next, the CPU 500 is shifted to the processing of step S104. That is, even if a side edge Se of a sheet S once falls within the permissible range D of the target position P0, if the side edge Se exceeds the permissible range D, the correction control is carried out.

In step S105, if the CPU 500 determines that the side edge Se is not in the permissible range D (S105: No), the correction control is carried out. As the correction control, the CPU 500 first obtains a differential value Ly between the target position P0 and the position Py of the side edge Se detected by the CIS 100*a*. The skew feeding angle with respect to the conveying direction of a sheet S by the steering mechanism 120*a* and the skew feeding velocity in the skew feeding direction are changed according to the differential value Ly.

That is, the CPU 500 calculates an angle of the steering motor 106*a* (S108), and changes turning angle θ of the steering motor 106*a* (S109) to the calculated angle. The CPU 500 also calculates a velocity of the conveying motor 105*a* (S110), and changes the rotation velocity V1 of the conveying motor 105*a* to the calculated velocity (S111).

This will be described more specifically. First, in step S108, a distance by which a position Py of a side edge Se of a sheet S detected by the CIS 100*a* is deviated from the target position P0, i.e., the differential value Ly is calculated.

In this first embodiment, the CPU 500 controls such that a velocity component of the skew feeding velocity of a sheet S by the steering mechanism 120*a* in the conveying direction is maintained at a constant velocity. That is, the CPU 500 sets the rotation velocity V1 of the conveying motor 105*a* such that the velocity component (vector component) of the rotation velocity V1 of the conveying motor 105*a* in the conveying direction becomes the reference value V0.

Here, since it is necessary to move the sheet S in a direction opposite from the deviating direction, it is necessary that a velocity component (vector component) V2 in the width direction intersecting with the conveying direction is set in a direction toward the target position P0. The velocity component V2 is determined by a distance Lx in which the correction control is converged (achieved or completed).

It is necessary that the operation for correcting a sheet S is converged between the downstream side steering roller 103*b* and the sheet detecting sensor 35. In the first embodiment, a convergence distance Lx is set to ½ of a distance between the steering roller 103*b* and the sheet detecting sensor 35 so that correction can be made at least twice.

To set the velocity component of the conveying motor 105*a* in the conveying direction to the reference value V0, and to move the position Py of a side edge Se of a sheet S to the target position P0 in the convergence distance Lx, the velocity component V2 of the conveying motor 105*a* is obtained by an equation: $V2=(Ly/Lx)\times V0$. That is, the greater the differential value Ly is, the more the CPU 500 increases the velocity component of the skew feeding velocity of the steering mechanism 120*a* in the width direction. This will be described specifically. The greater the differential value Ly is, the more the CPU 500 increases the velocity component V2 of the conveying motor 105*a* in the width direction. Since the velocity component V2 is determined, the turning angle θ of the steering motor 106*a* obtained in step S108 is calculated by $\theta=\tan-1(V2/V0)=\tan-1(Ly/Lx)$.

Next, since the rotation velocity V1 of the conveying motor 105*a* obtained in step S110 is determined such that the velocity component in the conveying direction is maintained at the reference value V0, the rotation velocity V1 is obtained by an equation: $V1=V0/\cos\theta$. Velocities and angles of the conveying motor 105*b* and the steering motor 106*b* are also changed to velocities and angles obtained by the same equation.

Figure 7A:
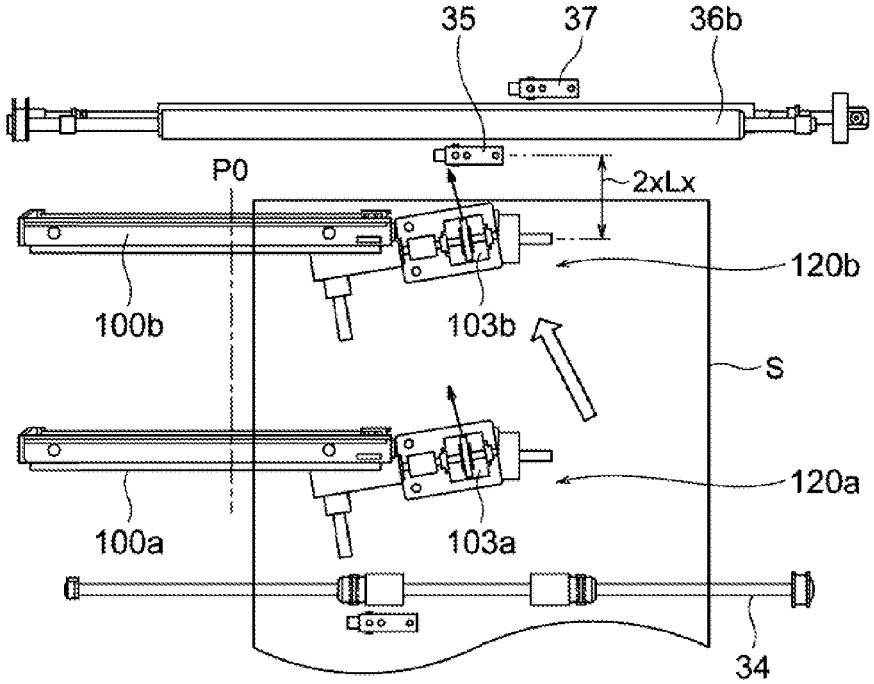
FIG. 7A is a plan view illustrating a state at the time of control of sheet position (attitude) of the sheet position (attitude) correcting portion (when a sheet is deviated rightward with respect to a target position)
Figure 7B:
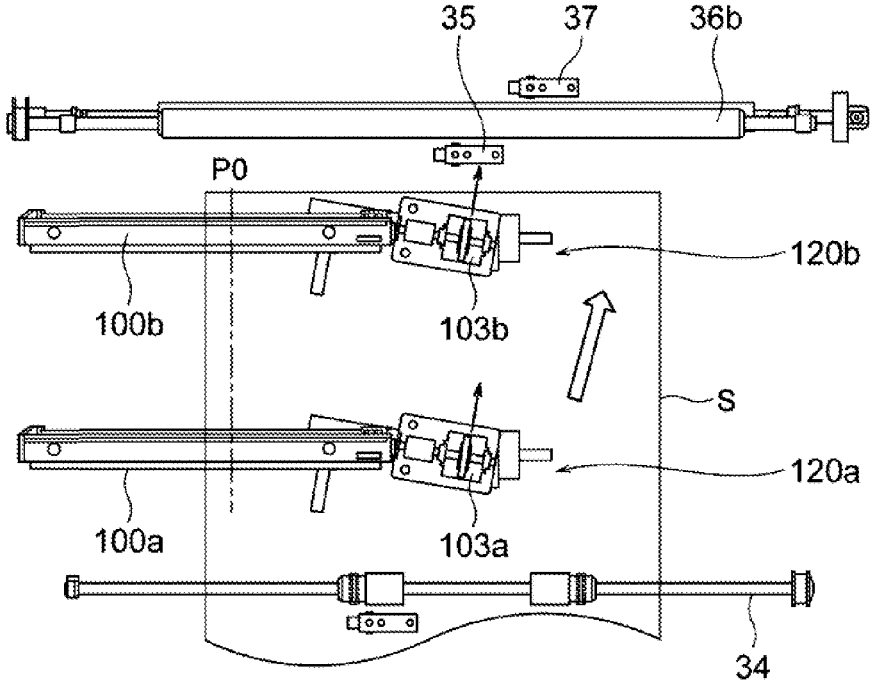
FIG. 7B is a plan view illustrating a state at the time of control of sheet position (attitude) of the sheet position (attitude) correcting portion (when a sheet is deviated leftward with respect to a target position)

A state of the position control of a sheet S carried out by the above sequence will be described using FIGS. 7 to 9. FIG. 7A illustrates a case where a sheet S is deviated rightward with respect to the target position P0, and FIG. 7B illustrates a case where a sheet S is deviated leftward with respect to the target position P0. In any cases, the steering rollers 103*a* and 103*b* are turned by the steering motors 106*a* and 106*b*, and rotated in the direction of arrows. According to this, the sheet S is moved in a direction of an outlined arrow in which the position Py of the side edge Se approaches the target position P0.

Figure 8A:
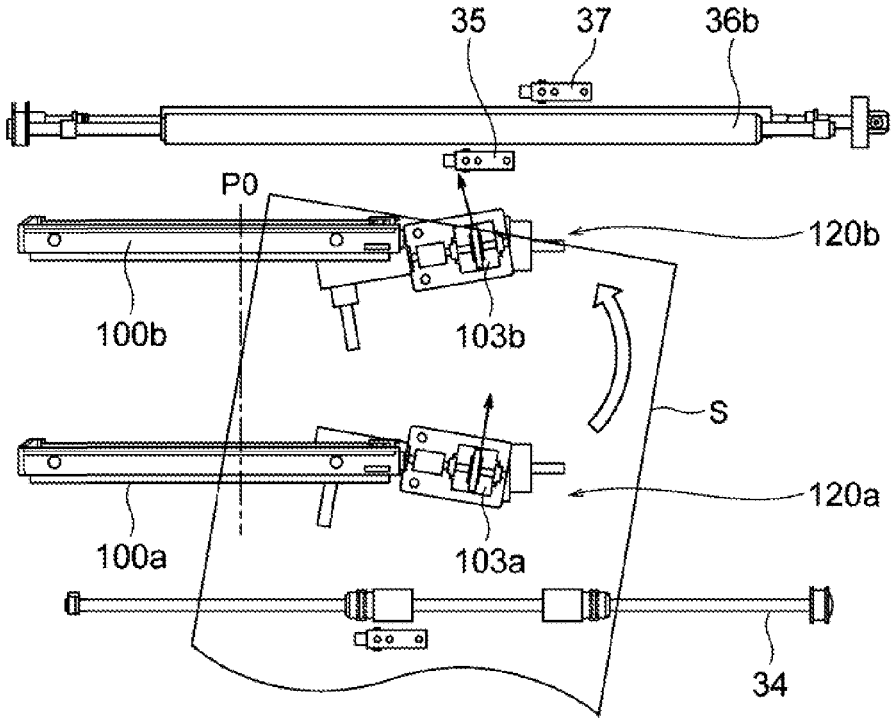
FIG. 8A is a plan view illustrating a state at the time of control of sheet position (attitude) of the sheet position (attitude) correcting portion (when a sheet is skew-fed)

Next, FIG. 8A illustrates a case where a sheet S is skew-fed. In the downstream side CIS 100*b*, a position Py of a side edge Se of a sheet S is deviated rightward with respect to the target position P0, the downstream side steering roller 103*b* turns in a direction deviating the sheet S leftward by the steering motor 106*b*. On the other hand, in the upstream side CIS 100*a*, since a position Py of a side edge Se of a sheet S is deviated leftward with respect to the target position P0, the upstream side steering roller 103*a* is turned in a direction deviating the sheet S rightward by the steering motor 106*a*. According to this, the downstream side steering roller 103*b* tries to deviate the sheet S leftward, and the upstream side steering roller 103*a* tries to deviate the sheet S rightward. As a result, the sheet S turns as illustrated with the outlined arrow. Since the constant velocity component in the conveying direction is maintained and the velocity component in the width direction is varied, it is possible to easily turn a sheet S without giving stress to the sheet S. According to this, since even an ultra-thin paper sheet having weak elasticity is not bent, it is possible to carry out precise position control.

Figure 8B:
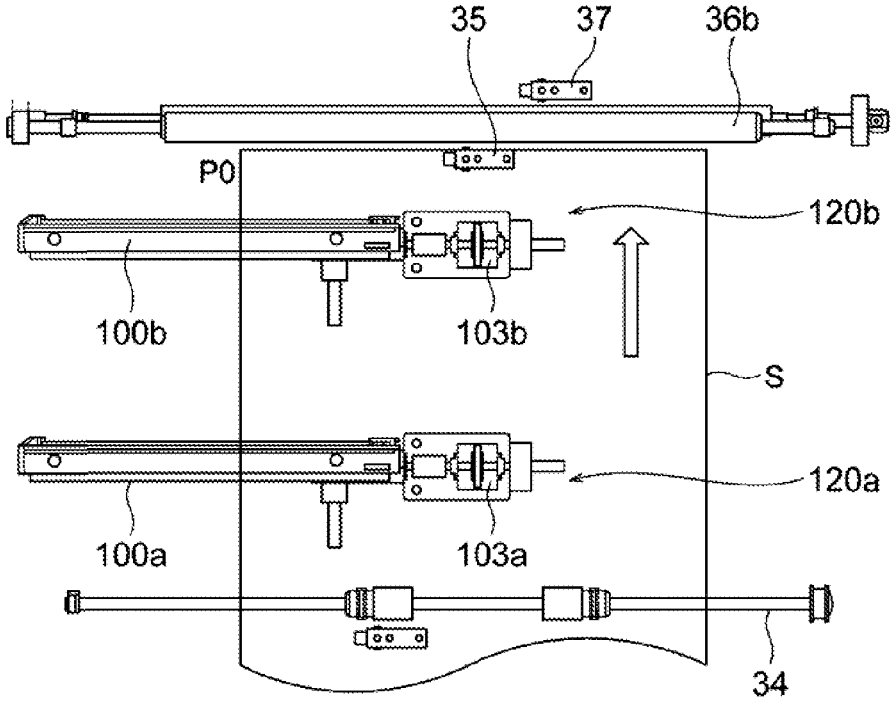
FIG. 8B is a plan view illustrating a state at the time of control of sheet position (attitude) of the sheet position (attitude) correcting portion (when position (attitude) control of a sheet is completed)

FIG. 8B illustrates a state where the position control of a sheet S is completed, and when the sheet detecting sensor 35 detects a sheet S, the CPU 500 sets the skew feeding angles of the steering mechanisms 120*a* and 120*b* to 0°. According to this, it is possible to control the position correction until just before the pair of registration rollers 36*a* and 36*b* which is stable with respect to the conveyance nips a sheet S. Therefore, it is possible to reduce a degree of an influence of conveyance precision (outer diameters of the rollers and angle precision of the steering motors) of the steering rollers 103*a* and 103*b* exerted on precision of control of the position correction of the sheet S. Since the pair of registration rollers 36*a* and 36*b* does not stop when a sheet S is conveyed, skew feeding which may be caused by colliding motion is not generated.

In the first embodiment, a position of an image and a position of a leading edge (tip end) of a sheet S are aligned by acceleration and deceleration of the pair of registration rollers 36*a* and 36*b*, but the steering mechanisms 120*a* and 120*b* may have such functions and the pair of registration rollers may be omitted. In this case, it is possible to carry out the position correction control until just before an image is formed on the sheet S by the image forming portion 90.

Figure 9A:
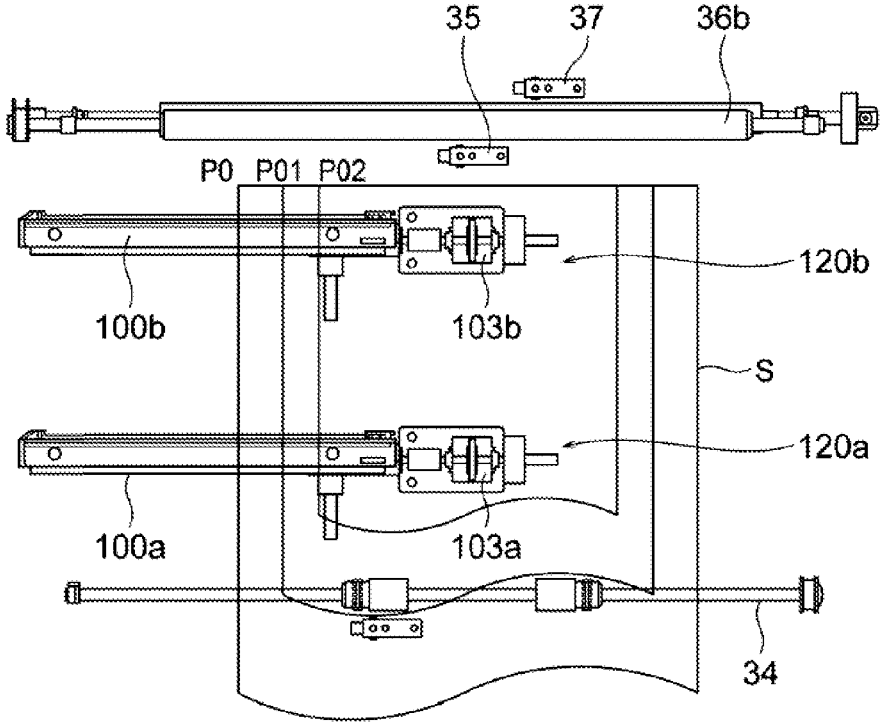
FIG. 9A is a plan view illustrating a state at the time of control of sheet position (attitude) of the sheet position (attitude) correcting portion (conveyance position by sheet size)

Next, in the first embodiment, a sheet S is conveyed on a central line as a reference as illustrated in FIG. 9A but when sheets S having different sizes are conveyed, since the CISs 100*a* and 100*b* are used, the CPU 500 sets target positions P0, P01 and P02 for each of sizes. Sheet size information is input to the CPU 500 by a personal computer through the operation portion 250 or the network 503. Alternatively, the sheet size information is input to the CPU 500 by a sheet size detecting unit (not illustrated) provided in the sheet feeding apparatus 1B.

Meanwhile, when the (side of the) image forming portion 90 and the (side of the) registration unit 30 are misaligned with each other, even if the position control is properly carried out, positions of the image and the sheet may be deviated from each other in some cases. When a position of the registration unit 30 itself is adjusted to the image, it is necessary to stop the apparatus, and the operation becomes complicated.

Figure 9B:
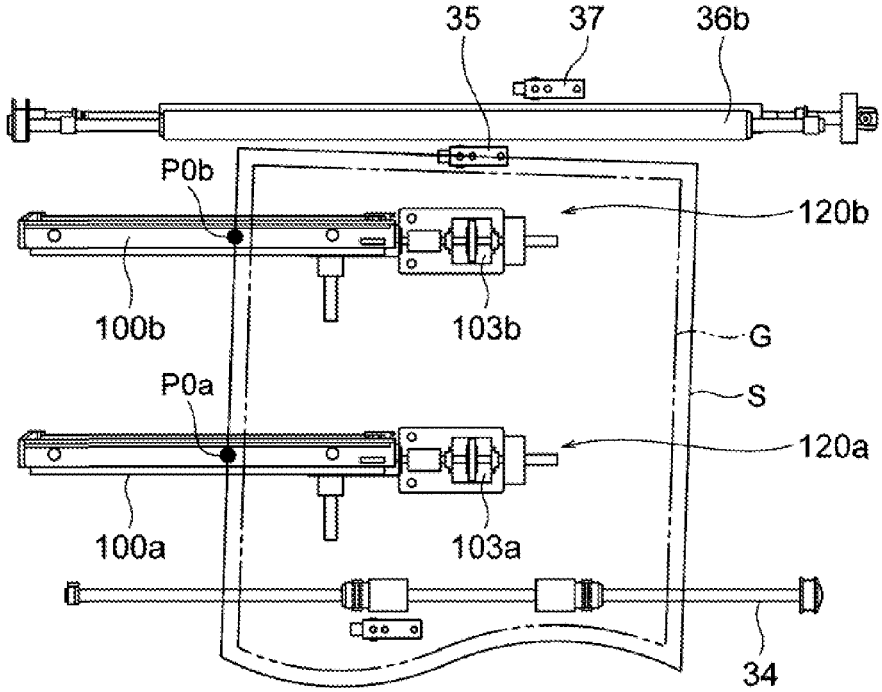
FIG. 9B is a plan view illustrating a state at the time of control of sheet position (attitude) of the sheet position (attitude) correcting portion (illustrating a conveyance position by sheet size and illustrating a conveyance position when alignment is corrected)

Hence, in the first embodiment, as illustrated in FIG. 9B, the target positions are set corresponding to the CISs 100*a* and 100*b*, and the target positions P0*a* and P0*b* corresponding to the CISs 100*a* and 100*b* can be changed. If the upstream side target position P0*a* and the downstream side target position P0*b* are deviated and set by the misaligned amount, it is possible to adjust the deviation between a sheet S and an image G. As the adjusting operation, an adjustment value is input by the computer 504 through the operation portion 250 or the network 503. According to this, it is possible to carry out the operation easily. There is also a merit that cost required for introducing an adjusting unit can be suppressed. If a unit which detects a deviation between an image and a sheet is provided in the apparatus, it is possible to adjust automatically.

When a thick sheet is conveyed, upstream side and downstream side target positions P0*a* and P0*b* may be deviated and set. According to this, the sheet is conveyed in its inclined state, and a leading edge (tip end) of a sheet and the secondary transfer inner roller 43 and the secondary transfer outer roller 44 of the secondary transfer portion are not in parallel to each other. Therefore, it is possible to suppress abrupt load variation at the time of transfer nip biting, and a case where a velocity of the intermediate transfer belt 40 is varied and unevenness is generated can be suppressed. It is necessary to incline an image to be transferred according to a sheet, but since the inclination amount of each sheet is constant, it does not take time for variation of color caused by deviation of dot formation of each color on every sheet of a color image, and for calculation to incline an image, and productivity is not largely reduced.

In the first embodiment, velocities and angles of the conveying motors 105*a* and 105*b* and the steering motors 106*a* and 106*b* are changed to the velocities and angles obtained by the above-described equations. Therefore, bending of a sheet S can be suppressed, a case where stress is given to the sheet S can be suppressed, and it is possible to correct skew feeding of a sheet S and to carry out the precise positioning of a side end Se of a sheet S. It is also possible to correct skew feeding of a sheet S and to carry out the precise positioning of a side end Se of a sheet S with respect to various kinds of materials including a thin paper sheet. Since the differential values Ly are obtained and the skew feeding angles and the skew feeding velocities of the steering mechanisms 120*a* and 120*b* are changed, an amount of overshoot of a sheet S in the width direction is reduced, and it is possible to swiftly bring a side end Se of the sheet S close to the target position P0. Thus, it is possible to enhance the position precision of an image with respect to a sheet S, to convey a sheet fast, and to enhance the productivity.

By maintaining the velocity components of the conveying motors 105*a* and 105*b* in the conveying direction at the reference values V0, it is possible to prevent a distance between sheets S from being deviated, and even when it is desired to reduce the distance between the sheets S to enhance the productivity, it is possible to convey the sheets S stably. It is possible to effectively prevent the bending of a sheet S and a case where both the steering rollers 103*a* and 103*b* pull each other. As the differential value Ly is greater, the velocity component V2 is increased and thus, a side end Se of a sheet S can swiftly be brought close to the target position P0.

In the above description, the velocity of the conveying motor 105*a* is changed and then, the angle of the steering motor 106*a* is changed, but the angle of the steering motor 106*a* and the velocity of the conveying motor 105*a* may be changed substantially at the same time.

In the first embodiment, the angles of the steering rollers 103*a* and 103*b* can be controlled more finely by the steering motors 106*a* and 106*b*, and it is also possible to use only one pattern of the largest control angle from the convergence distance Lx and the maximum deviation amount. In that case, since only one pattern in which the reference value V0 and its angle are added is sufficient for a velocity of the conveying motor 105*a*, it is possible to constitute the apparatus relatively inexpensively.

Second Embodiment

Next, a sheet position correcting portion 301 of a sheet conveying apparatus of an image forming apparatus according to a second embodiment of the present invention will be described. The same configurations as those of the first embodiment are designated with the same symbols and description thereof will be omitted.

Figure 10A:
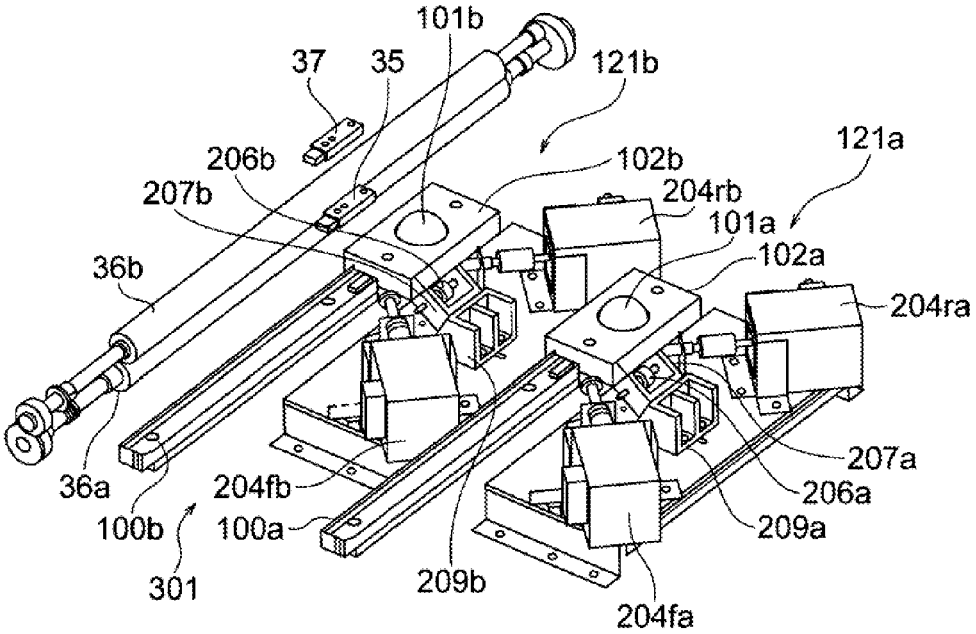
FIG. 10A is a perspective view illustrating an essential portion of a sheet position (attitude) correcting portion according to a second embodiment.

As illustrated in FIG. 10A, the sheet position correcting portion 301 includes two ball conveying mechanisms 121*a* and 121*b* as two conveying portions. The ball conveying mechanisms 121*a* and 121*b* can feed a sheet S on the skew in any direction with respect to a conveying direction, and are disposed along the conveying direction upstream of the image forming portion 90 in the conveying direction. The ball conveying mechanism 121*a* and the ball conveying mechanism 121*b* are formed of similar members.

The sheet position correcting portion 301 includes CISs 100*a* and 100*b* as two side end position detectors which detect one side end position of a sheet in the width direction intersecting with the conveying direction of a sheet. The CISs 100*a* and 100*b* are disposed along the conveying direction corresponding to the ball conveying mechanisms 121*a* and 121*b*.

Figure 10B:
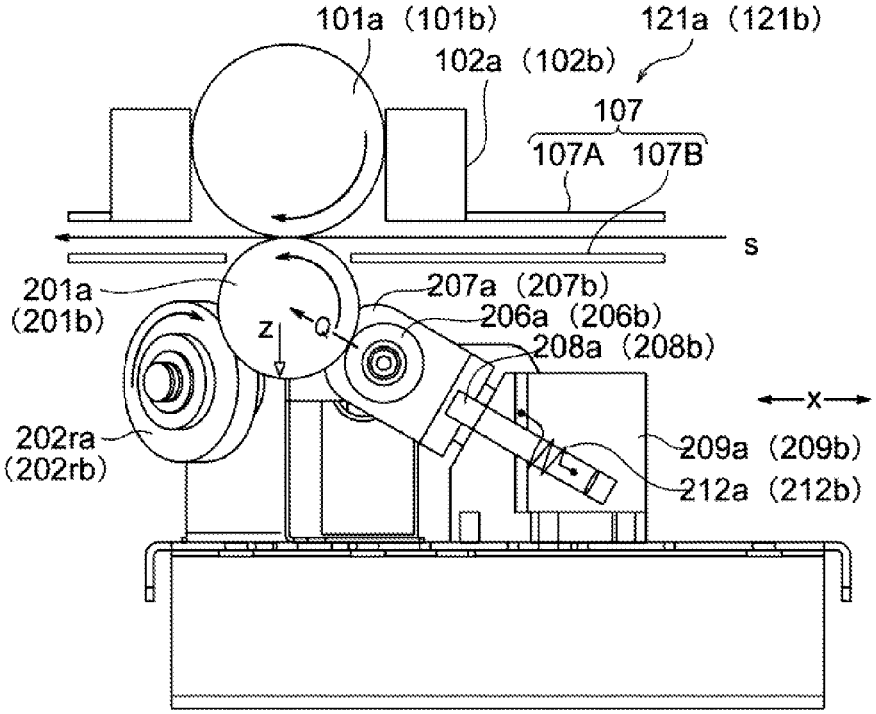
FIG. 10B is an explanatory diagram illustrating a ball conveying mechanism.

As illustrated in FIG. 10B, the ball conveying mechanisms 121*a* and 121*b* include conveying balls 201*a* and 201*b* as spherical conveying rotating members which can rotate in any direction. The ball conveying mechanisms 121*a* and 121*b* include spherical follower balls 101*a* and 101*b* as follower rotating members, and the follower balls 101*a* and 101*b* are disposed above the conveying balls 201*a* and 201*b* and press upper portions of the conveying balls 201*a* and 201*b* and follow the conveying balls 201*a* and 201*b*. The conveying balls 201*a* and 201*b* and the follower balls 101*a* and 101*b* nip and convey a sheet S.

The conveying balls 201*a* and 201*b* are spheres made of rubber, and are disposed at a central portion of the apparatus body 1A in the width direction. Although the conveying balls 201*a* and 201*b* are disposed at the central portion, they may not be disposed at the central position only if they can convey a sheet S. The follower balls 101*a* and 101*b* are metal spheres. The follower balls 101*a* and 101*b* are vertically movably supported by ball guides 102*a* and 102*b* provided above an upper one (107A) of the pair of conveying guides 107. More specifically, the follower balls 101*a* and 101*b* are vertically movably inserted into holes of the ball guides 102*a* and 102*b*. The follower balls 101*a* and 101*b* press the conveying balls 201*a* and 201*b* by their own weights. Since the follower balls 101*a* and 101*b* are spherical, they can follow and rotate even if conveying vectors of the conveying balls 201*a* and 201*b* are changed.

The CISs 100*a* and 100*b* are provided on the upper one (107A) of the pair of conveying guides 107, and are disposed on a nip center line extending in the width direction of the conveying balls 201*a* and 201*b* and the follower balls 101*a* and 101*b*. It is preferable that the CISs 100*a* and 100*b* are disposed on the nip line, but the invention is not limited to this. The pair of conveying guides 107 is black plated, and the CISs 100*a* and 100*b* detect a boundary of a lightness difference between a sheet S and the pair of conveying guides 107, thereby detecting a side end position of the sheet S.

Figure 11A:
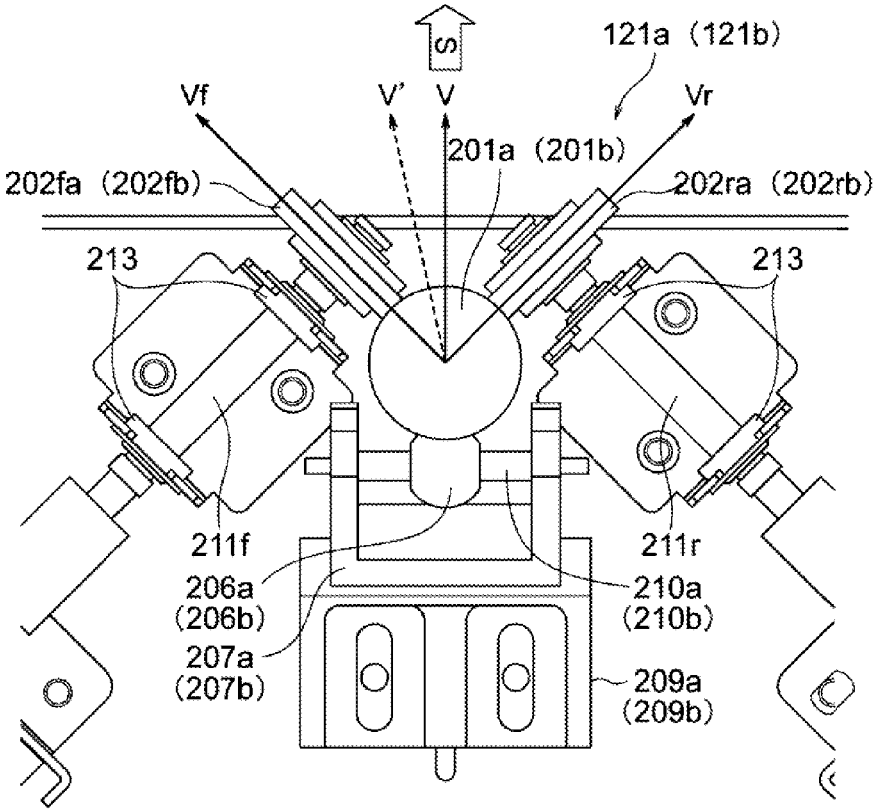
FIG. 11A is a plan view of an essential portion of the ball conveying mechanism.

As illustrated in FIG. 11A, the ball conveying mechanism 121*a* includes two drive rollers 202*fa* and 202*ra* which are disposed below the conveying ball 201*a* and which press a lower portion of the conveying ball 201*a* to rotate and drive the conveying ball 201*a*. The ball conveying mechanism 121*a* includes a follower roller 206*a* which presses a lower portion of the conveying ball 201*a* and which follows the conveying ball 201*a*. The conveying ball 201*a* is supported by the two drive rollers 202*fa* and 202*ra* and the follower roller 206*a* from below at three points. Similarly, the ball conveying mechanism 121*b* includes two drive rollers 202*fb* and 202*rb* and a follower roller 206*b*, and the conveying ball 201*b* is supported by them from below at three points. In FIG. 10B, a sheet S is conveyed in a direction of the arrow indicated by S, and at that time, the drive rollers 202*ra* and 202*rb* rotate in a clockwise direction, and the conveying balls 201*a* and 201*b* rotate in a counterclockwise direction. The drive rollers 202*fa* and 202*fb* are not illustrated because the drawing is a sectional view, but they rotate in the clockwise direction as viewed from the front.

The ball conveying mechanisms 121*a* and 121*b* include follower roller supporting stages 207*a* and 207*b* which rotatably support the follower rollers 206*a* and 206*b*, and bases 209*a* and 209*b* which support the follower roller supporting stages 207*a* and 207*b*. The bases 209*a* and 209*b* turnably support the follower roller supporting stages 207*a* and 207*b* around an axis Q extending toward centers of the conveying balls 201*a* and 201*b* such that the follower rollers 206*a* and 206*b* follow the rotating direction of the conveying balls 201*a* and 201*b*. Specifically, the follower rollers 206*a* and 206*b* are rotatably supported by shafts 210*a* and 210*b*, and the shaft 210*a* and 210*b* are supported by the follower roller supporting stages 207*a* and 207*b*. Shafts 208*a* and 208*b* which are in parallel to the axis Q extending toward the centers of the conveying balls 201*a* and 201*b* are fixed to the follower roller supporting stages 207*a* and 207*b*. The shafts 208*a* and 208*b* are turnably supported by bases 209*a* and 209*b* so that the follower rollers 206*a* and 206*b* can oscillate around the conveying balls 201*a* and 201*b*. One ends of torsion springs 212*a* and 212*b* are fixed to the shafts 208*a* and 208*b*, and the other ends of the torsion springs 212*a* and 212*b* are fixed to the bases 209*a* and 209*b*. In an initial state, a rotation direction of the follower rollers 206*a* and 206*b* is set in parallel to the conveying direction.

Peripheral surfaces of the drive rollers 202*fa* and 202*ra* and the drive rollers 202*fb* and 202*rb* are made of rubber. The follower rollers 206*a* and 206*b* are resin rollers having excellent sliding performance. The conveying ball 201*a* is pressed downward by its own weight and a weight of the follower ball 101*a*, and the conveying ball 201*a* presses the two drive rollers 202*fa* and 202*ra* and the follower roller 206*a*. Therefore, rotation forces of the drive rollers 202*fa* and 202*ra* are transmitted to the conveying ball 201*a* by a friction force, and the conveying ball 201*a* is rotated and driven. Similarly, the conveying ball 201*b* is pressed downward by its own weight and a weight of the follower ball 101*b*, and the conveying ball 201*b* presses the two drive rollers 202*fb* and 202*rb* and the follower roller 206*b*. Therefore, rotation forces of the drive rollers 202*fb* and 202*rb* are transmitted to the conveying ball 201*b* by a friction force, and the conveying ball 201*b* is rotated and driven.

Since the conveying ball 201*a* (201*b*) is supported from below at three points, the conveying ball 201*a* (201*b*) can effectively press the two drive rollers 202*fa* and 202*ra* (202*fb*, 202*rb*). Therefore, rotation forces of the two drive rollers 202*fa* and 202*ra* (202*fb*, 202*rb*) can be transmitted to the conveying ball 201*a* (201*b*), and the conveying ball 201*a* (201*b*) can be rotated stably. The weight of the conveying ball 201*a* (201*b*) applied to the two drive rollers 202*fa* and 202*ra* (202*fb*, 202*rb*) and the follower rollers 206*a* (206*b*) is not varied almost at all. Thus, variation of friction forces between the two drive rollers 202*fa* and 202*ra* (202*fb*, 202*rb*), the follower roller 206*a* (206*b*) and the conveying ball 201*a* (201*b*) can be reduced. By the above configuration, rotation velocities and rotation directions of the conveying ball 201*a* (201*b*) are stabilized, and it is possible to stably convey a sheet S in a desired direction at a desired conveying velocity. Therefore, it is possible to precisely correct a position of a sheet. Since the drive rollers 202*fa* and 202*ra* (202*fb*, 202*rb*) press the conveying ball 201*a* (201*b*), it is unnecessary to separately prepare a motor and thus, a structure thereof is simple. Therefore, the apparatus can be reduced in size and in cost.

As illustrated in FIG. 11A, the drive rollers 202*fa* and 202*ra* are disposed downstream of the conveying ball 201*a* in the conveying direction, and the follower roller 206*a* is disposed upstream of the conveying ball 201*a* in the conveying direction. Specifically, the two drive rollers 202*fa* and 202*ra* are disposed laterally symmetrically in the width direction with respect to the conveying direction around the conveying ball 201*a*. In this embodiment, the drive rollers 202*fa* and 202*ra* are disposed downstream of the conveying ball 201*a* in the conveying direction and symmetric with respect to the conveying direction at 45° with respect to the conveying direction from the center of the conveying ball 201*a*. The follower roller 206*a* is disposed upstream of the conveying ball 201*a* in the conveying direction on an axis extending in the conveying direction from the center of the conveying ball 201*a*. Similarly, the drive rollers 202*fb* and 202*rb* are disposed downstream of the conveying ball 201*b* in the conveying direction symmetrically with respect to the conveying direction from the center of the conveying ball 201*b* at 45°. The follower roller 206*b* is disposed upstream of the conveying ball 201*b* in the conveying direction on an axis extending in the conveying direction from the center of the conveying ball 201*b*. In this embodiment, the drive rollers 202*fa* and 202*ra* (202*fb*, 202*rb*) are disposed symmetrically downstream of the conveying ball 201*a* (201*b*) at 45°, but this angle need not be 45°. Disposition angles of the drive rollers 202*fa* and 202*ra* (202*fb*, 202*rb*) may be determined according to the maximum velocity at which it is moved in a direction intersecting with the conveying direction, and the angle may be set in a range of 30° to 60° because it is supported at three points.

Since the drive rollers 202*fa* and 202*ra* are disposed downstream of the conveying ball 201*a* in this manner, if the drive rollers 202*fa* and 202*ra* are rotated and driven, a force is given to the conveying ball 201*a* downwardly (a direction of the arrow Z in FIG. 10B). According to this, a force is given to the conveying ball 201*a* in a direction in which the conveying ball 201*a* presses the drive rollers 202*fa* and 202*ra* and the follower roller 206*a*. Therefore, the conveying ball 201*a* is prevented from uplift, and since the drive rollers 202*fa* and 202*ra* and the follower roller 206*a* come into more intimate contact with the conveying ball 201*a*, rotation of the conveying ball 201*a* is stabilized. Similarly, a force in a direction in which the conveying ball 201*b* presses the drive rollers 202*fb* and 202*rb* and the follower roller 206*b* is given to the conveying ball 201*b*. Therefore, the conveying ball 201*b* is prevented from uplift, and since the drive rollers 202*fb* and 202*rb* and the follower roller 206*b* come into more intimate contact with the conveying ball 201*b*, rotation of the conveying ball 201*b* is stabilized.

The ball conveying mechanism 121*a* includes two ball drive motors 204*fa* and 204*ra* (FIG. 10A) as two driving portions which respectively rotate and drive the drive rollers 202*fa* and 202*ra*. The ball conveying mechanism 121*b* includes two ball drive motor 204*fb*, 204*rb* (FIG. 10A) as two driving portions which respectively rotate and drive the drive rollers 202*fb* and 202*rb*. The drive rollers 202*fa* and 202*ra* are connected to the ball drive motors 204*fa* and 204*ra* through shafts 211*f* and 211*r*, respectively, and the shafts 211*f* and 211*r* are rotatably supported by bearings 113. Similarly, the drive rollers 202*fb* and 202*rb* are connected to the ball drive motor 204*fb*, 204*rb* through the shafts 211*f* and 211*r*, respectively, and the shafts 211*f* and 211*r* are rotatably supported by the bearings 113. The ball drive motors 204*fa*, 204*ra*, 204*fb* and 204*rb* are stepping motors, and velocities thereof can be set arbitrarily.

Figure 11B:
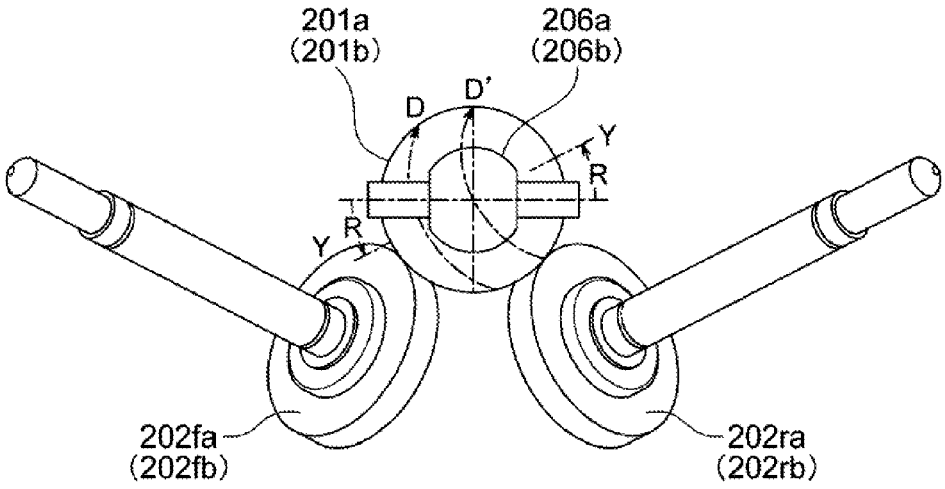
FIG. 11B is an explanatory diagram of the essential portion of the ball conveying mechanism.

FIG. 11B illustrates the follower roller 206*a* (206*b*) and the conveying ball 201*a* (201*b*) as viewed in the direction of the axis Q, but a rotating direction of the conveying ball 201*a* (201*b*) is not determined. For example, an equator rotates in a direction of the arrow D illustrated with a dashed line around a Y-Y axis, a track on the follower roller 206*a* (206*b*) is directed in a direction of the arrow D' illustrated with a dashed-dotted line. In this embodiment, since the follower roller 206*a* (206*b*) can incline around the shaft 208*a* (208*b*), the follower roller 206*a* (206*b*) follows the rotating direction of the conveying ball 201*a* (201*b*) and inclines in the direction of the arrow R, and this does not become resistance of rotation of the conveying ball 201*a* (201*b*).

Since the conveying ball 201*a* (201*b*) is supported by the drive rollers 202*fa* and 202*ra* (202*fb*, 202*rb*) and the follower rollers 206*a* (206*b*) at three points, height of the conveying ball 201*a* is varied due to positions and tolerance of diameters.

Therefore, in this embodiment, a position of the follower roller 206*a* (206*b*) can be adjusted in a direction approaching and separated from the two drive rollers 202*fa* and 202*ra* (202*fb*, 202*rb*) as illustrated in FIG. 10B. More specifically, the base 209*a* (209*b*) can be adjusted in a direction of the arrow X which is in parallel to the conveying direction. By adjusting the base 209*a* (209*b*) and by adjusting a position of the follower roller 206*a* (206*b*), the height of the conveying ball 201*a* (201*b*) is adjusted. A center position with respect to the follower ball 101*a* (101*b*) is aligned by adjusting a position of the ball guide 102*a* (102*b*).

Figure 12:
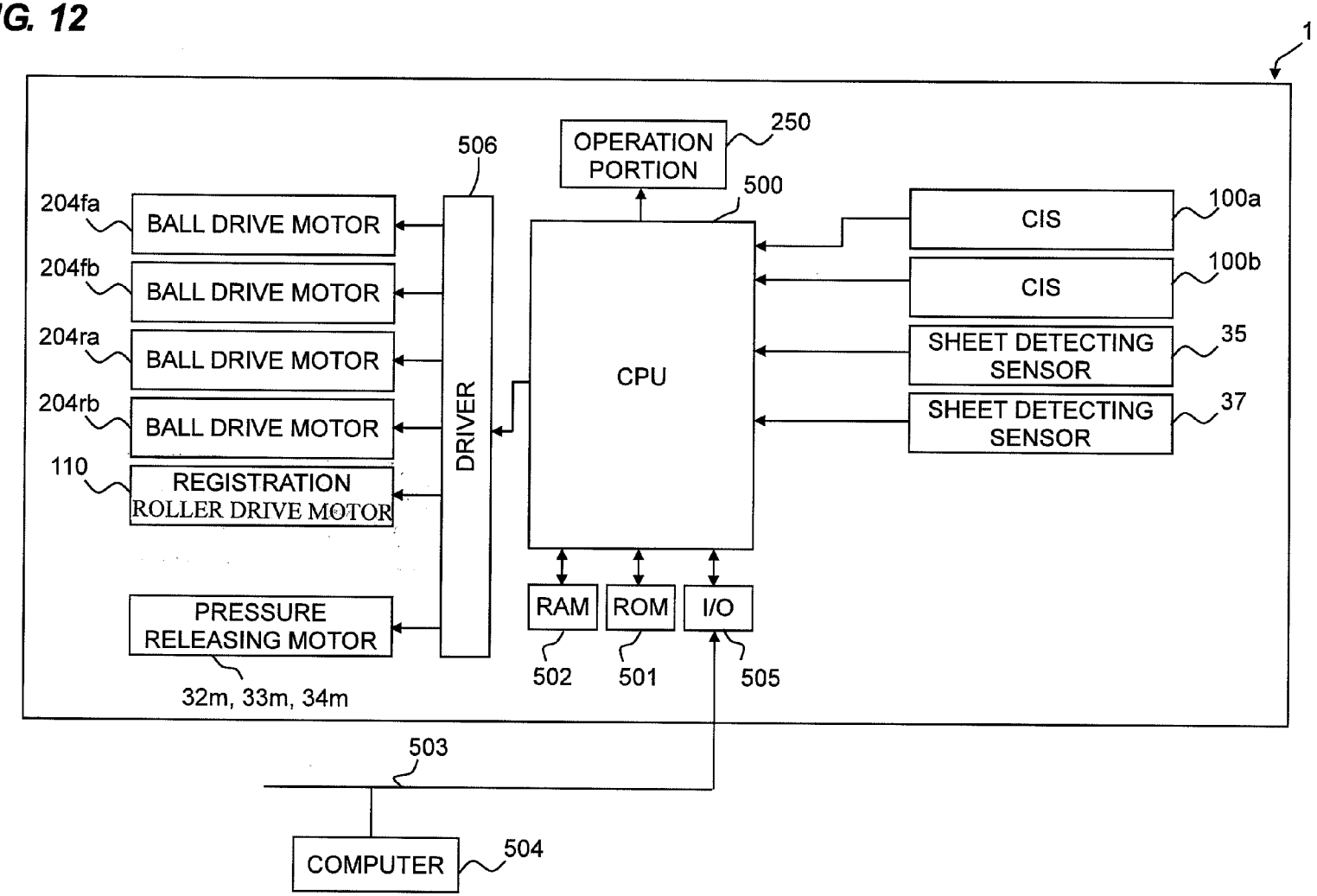
FIG. 12 is a block diagram illustrating a CPU of the image forming apparatus and a subject to be controlled by the CPU.

As illustrated in FIG. 12, the image forming apparatus 1 includes a CPU 500 as a controlling portion which controls the entire apparatus, a ROM 501 in which a control program is stored, and a RAM 502 used as a working area. The image forming apparatus 1 includes an I/O 505 connected to a computer 504 through a network 503. The image forming apparatus 1 also includes a registration roller drive motor 110 which rotates and drives the registration drive roller 36*a*, in addition to the ball drive motors 204*fa*, 204*fb*, 204*ra* and 204*rb*, pressure releasing motors 32*m*, 33*m*, and 34*m*. The CPU 500 outputs a command to a driver 506 and controls the motors based on information of the sensors, input information from the operation portion 250, and information which is input from the computer 504 through the I/O 505. That is, the CPU 500 operates the ball drive motors 204*fa*, 204*fb*, 204*ra* and 204*rb* and rotates the conveying balls 201*a* and 201*b* such that a sheet S is fed on the skew at a determined skew feeding angle and at a determined skew feeding velocity.

Figure 13:
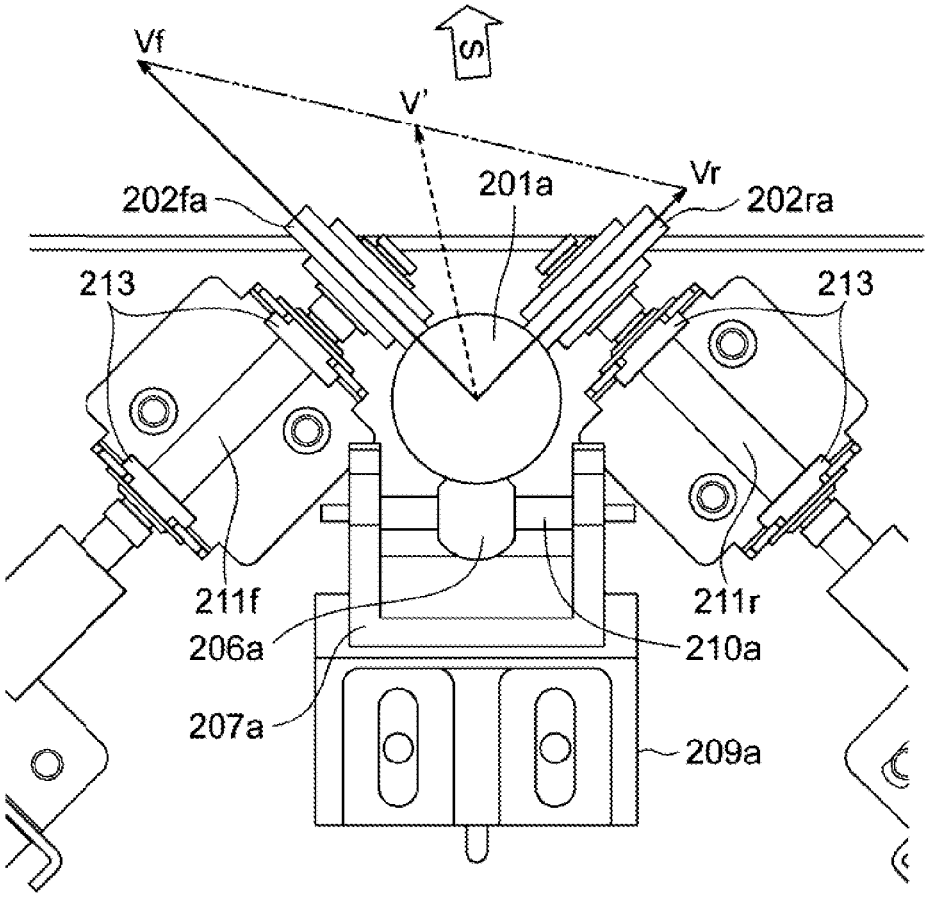
FIG. 13 is a diagram illustrating a velocity vector of a ball conveying mechanism.

Next, operations of the ball conveying mechanisms 121*a* and 121*b* of the sheet position correcting portion 301 will be described, but since the operations of the ball conveying mechanisms 121*a* and 121*b* are the same, the operation of one of the ball conveying mechanisms (121*a*) will be described. In FIG. 11A, the drive rollers 202*fa* and 202*ra* are disposed symmetrically in the conveying direction. When a sheet S is directed in the conveying direction illustrated with an outlined arrow, if a vector of the conveying velocity of the conveying ball 201 is defined as V, a sheet conveying velocity vector is changed by a velocity difference between a velocity Vf by driving of the drive roller 202*fa* and a velocity Vr by driving of the drive roller 202*ra*. In FIG. 11A, since Vf is equal to Vr, the sheet S is conveyed in the conveying direction toward the image forming portion 90. Next, when the sheet S is skew-fed, e.g., when the sheet S is moved to the front side as illustrated in FIG. 13, in order to set a conveying velocity vector to V', velocities of the drive rollers 202*fa* and 202*ra* are set such that Vf>Vr is established. In this manner, rotation velocities of the drive rollers 202*fa* and 202*ra* are adjusted by the ball drive motors 204*fa* and 204*ra*, a rotating direction and a rotation velocity of the conveying ball 201*a* are set. For example, when Vr is equal to 0 (ball drive motor 204*ra* is stopped), it can be conveyed toward the arrow Vf at the maximum angle of 45°. It is unnecessary to dispose the drive rollers 202*fa* and 202*ra* symmetrically, and when a sheet S is moved to only one side, one of the drive rollers may be disposed in parallel to the conveying direction.

Figure 14:
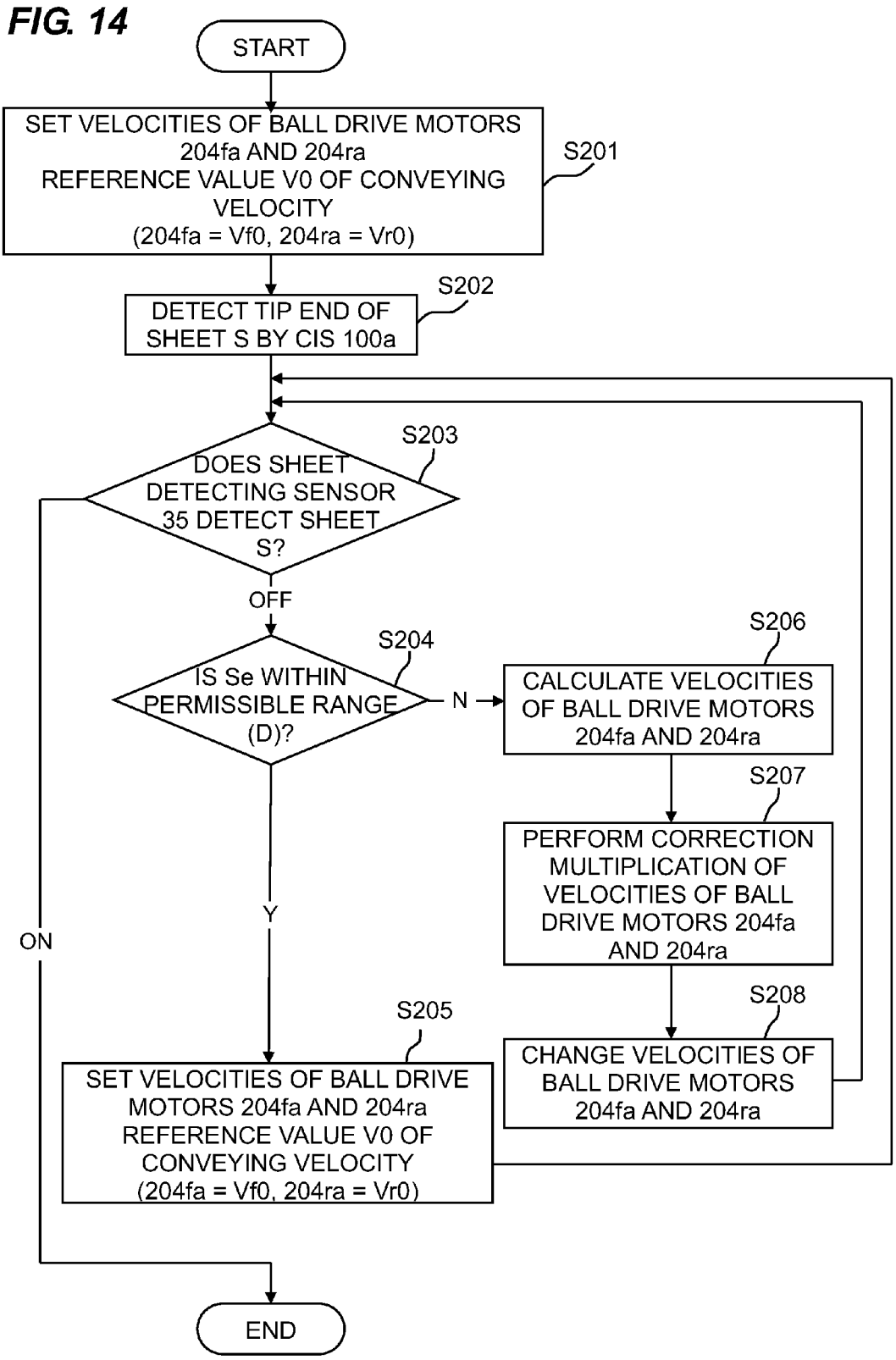
FIG. 14 is a flowchart of control of position (attitude) of a sheet conducted by a CPU.
Figure 15:
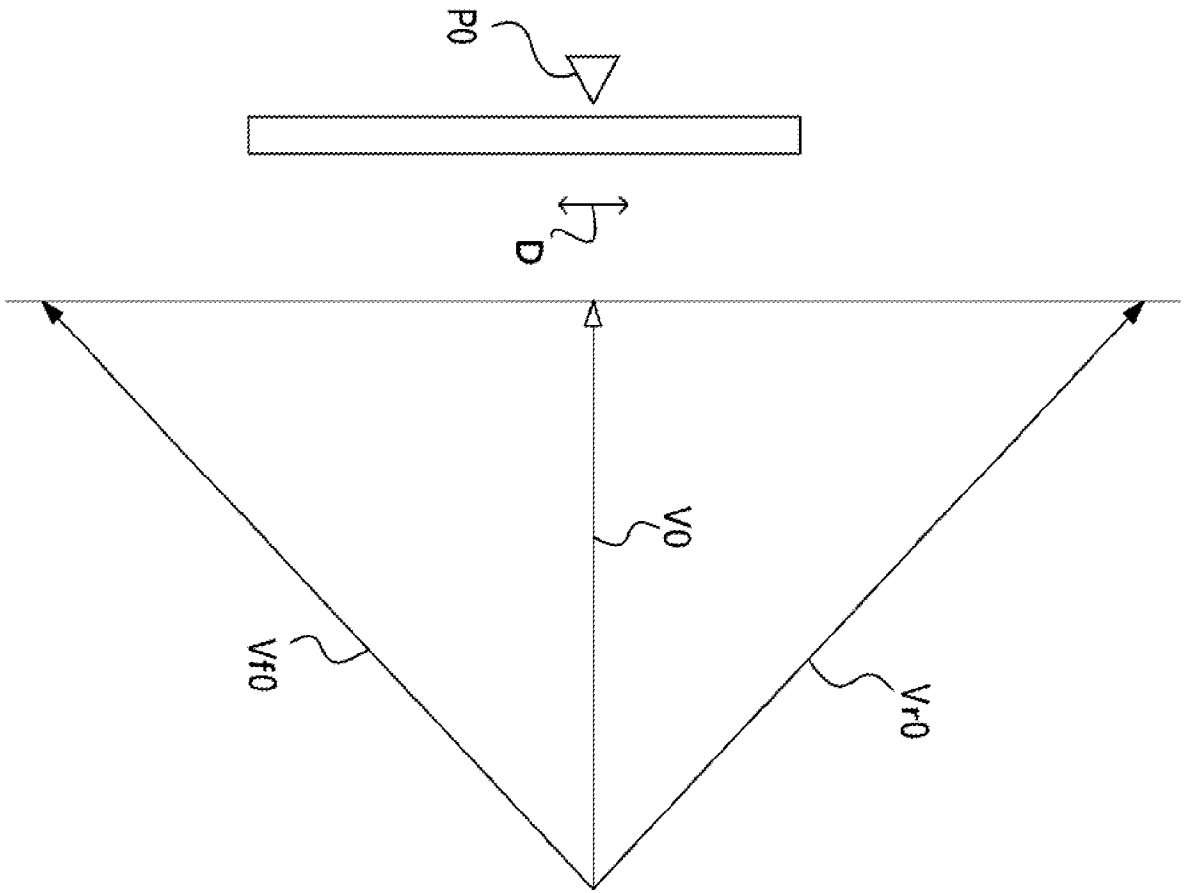
FIG. 15 is a diagram illustrating conception of calculation of correction control.
Figure 16:
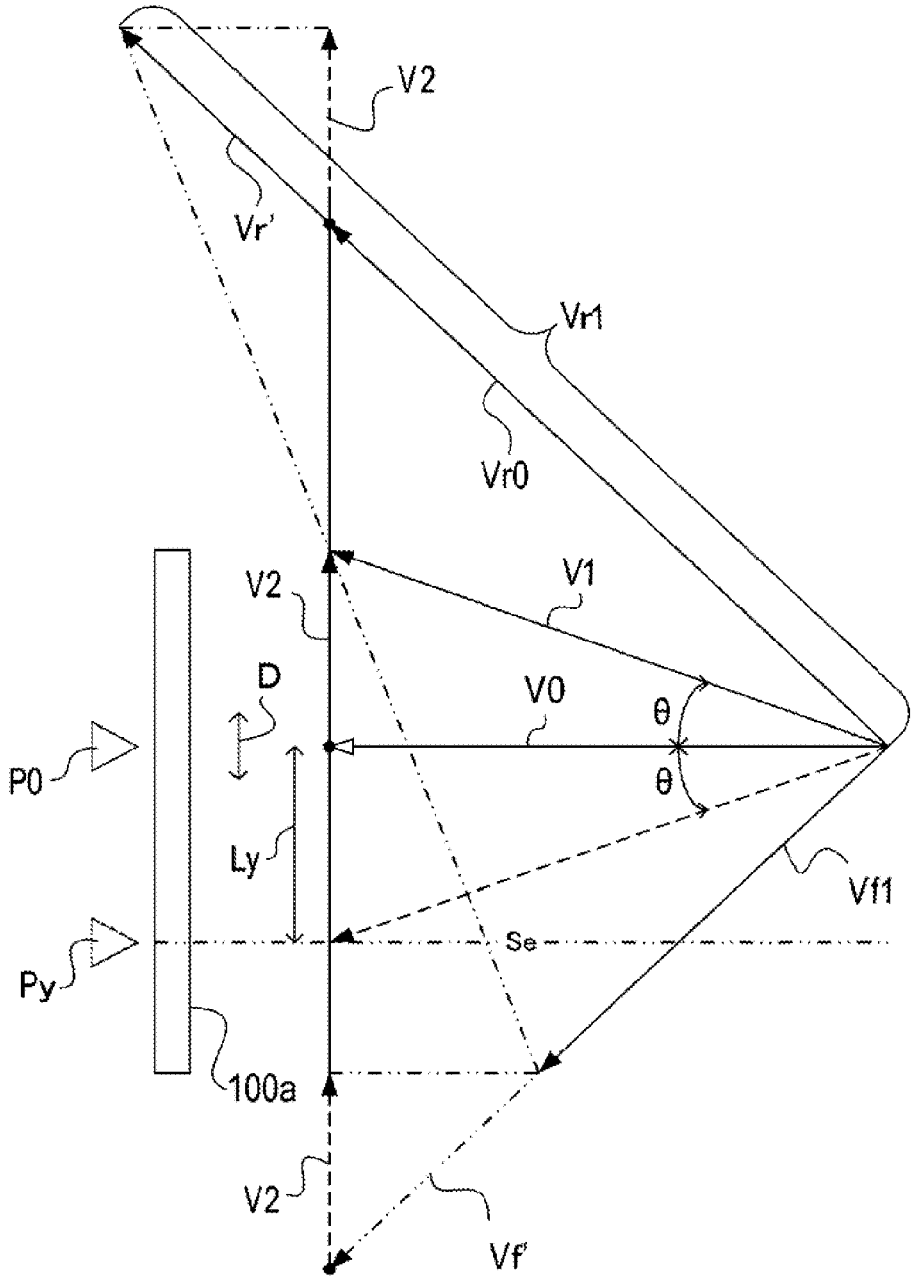
FIG. 16 is a diagram illustrating conception of calculation of correction control.

Next, sequence of the sheet position correcting portion 300 will be described based on a flowchart in FIG. 14. Since the control manners of the ball conveying mechanisms 121*a* and 121*b* are the same, one of the ball conveying mechanisms (121*a*) will be described. FIGS. 15 and 16 are diagrams illustrating conception of calculation of correction control.

When the apparatus body 1A is actuated, in order to set a rotation velocity of the conveying ball 201*a* to a reference value V0, the CPU 500 makes the drive rollers 202*fa* and 202*ra* start rotating at rotation velocities Vf0 and Vr0 by the ball drive motors 204*fa* and 204*ra* (S201). That is, the drive rollers 202*fa* and 202*ra* are rotated when Vf0 is equal to Vr0. In this embodiment, since the drive rollers 202*fa* and 202*ra* are symmetrically inclined at an angle of 45° with respect to the conveying direction, in order to set the reference value V0 to a velocity which is the same as the image forming velocity, the following equations are satisfied: Vf0=V0/cos 45° and Vr0=V0/cos 45°. According to this, a peripheral velocity of the conveying ball 201*a* which rotates at the reference value V0, i.e., the conveying velocity of a sheet S is the same as the image forming velocity of the image forming portion 90.

If a sheet S is sent from the upstream side in the conveying direction, since a side end position of the sheet S is detected by the CIS 100*a*, the CPU 500 determines that a leading edge (tip end) of the sheet S is reached, and starts the position control (S202). A sheet detecting sensor which determines that a leading edge (tip end) of a sheet S is reached may be disposed independently from the CIS 100*a*. When the position is controlled, if rollers located upstream in the conveying direction nip a sheet S, acting as resistance and it becomes difficult to change the position of the sheet S and therefore, pressures of the idler rollers 32*a*, 33*a* and 34*a* are released by the pressure releasing motors 32*m*, 33*m* and 34*m*.

Next, the CPU 500 determines whether the sheet detecting sensor 35 disposed immediately in front of the registration drive roller 36*a* detects a sheet (S203). When the sheet detecting sensor 35 detects a sheet S (S203: ON), the position control is completed, and when the sheet detecting sensor 35 does not detect a sheet S (S203: OFF), the correction control is continued.

Since a sheet S is conveyed in a skew feeding state or a state where a position thereof in the width direction is deviated, the CPU 500 determines whether a position Py of a side end Se of a sheet S detected by the CIS 100*a* is within a permissible range D including the target position P0 (S204). The target position P0 of a side end of a sheet is a value which is previously stored in a rewritable non-volatile memory such as the ROM 501 and an EEPROM. When it is determined that the position Py is within the permissible range D (S204: Yes), the ball drive motors 204*fa* and 204*ra* are brought back to initial states. That is, as illustrated in FIG. 15, the CPU 500 sets the rotation velocities of the ball drive motors 204*fa* and 204*ra* to Vf0 and Vr0, and sets the rotation velocity of the conveying ball 201*a* to a reference value V0 (S205). According to this, a sheet S is conveyed in the conveying direction at a constant velocity that is the same as the image forming velocity. Next, the procedure of the CPU 500 is shifted to procedure of step S203. That is, even if a side end Se of a sheet S once falls within the permissible range of the target position P0, if the side end Se exceeds the permissible range D, the correction control is carried out.

When it is determined that the side end Se is not within the permissible range D (S204: No), the CPU 500 executes the correction control. As the correction control, the CPU 500 first obtains a differential value Ly between the target position P0 and the position Py of the side end Se detected by the CIS 100*a*. A skew feeding angle and a skew feeding velocity in the skew feeding direction with respect to the conveying direction of a sheet S by the ball conveying mechanism 121*a* is changed according to the differential value Ly.

That is, the CPU 500 calculates rotation velocities of the ball drive motors 204*fa* and 204*ra* (S206), multiplies the calculated rotation velocity by a correction value (S207), and changes rotation velocities of the ball drive motors 204*fa* and 204*ra* (S208).

The embodiment will be described specifically with reference to FIG. 16. First, in step S206, a distance by which a position Py of a side end Se of a sheet S detected by the CIS 100*a* is deviated from the target position P0, i.e., the differential value Ly is calculated.

Here, in the second embodiment, the CPU 500 controls such that a constant velocity component of a skew feeding velocity of a sheet S by the ball conveying mechanism 121*a* in the conveying direction is maintained. That is, the CPU 500 sets rotation velocities Vf1 and Vr1 of the ball drive motors 204*fa* and 204*ra* such that the velocity component of the rotation velocity of the conveying ball 201*a* in the conveying direction becomes equal to the reference value V0.

Here, since it is necessary to move the sheet S in a direction opposite from the deviating direction, it is necessary that a velocity component (vector component) V2 in the width direction intersecting with the conveying direction is set in a direction toward the target position P0. The velocity component V2 is determined by a distance Lx in which the correction control is converged.

It is necessary that the operation for correcting a sheet S is converged between the downstream side conveying ball 201*b* and the sheet detecting sensor 35. In the second embodiment, a convergence distance Lx is set to ½ of a distance between the conveying ball 201*b* and the sheet detecting sensor 35 so that correction can be made at least twice.

To set the velocity component of the conveying ball 201*a* in the conveying direction to the reference value V0, and to move the position Py of a side end Se of a sheet S to the target position P0 in the convergence distance Lx, the velocity component V2 of the conveying ball 201*a* is obtained by an equation: V2=(Ly/Lx)×V0. That is, the greater the differential value Ly is, the more the CPU 500 increases the velocity component of the skew feeding velocity of the ball conveying mechanism 121*a* in the width direction. This will be described specifically. The greater the differential value Ly is, the more the CPU 500 increases the velocity component V2 of the conveying ball 201*a* in the width direction. Since the velocity component V2 is determined, the skew feeding angle θ of the conveying ball 201*a* is determined by θ=tan−1(V2/V0)=tan−1(Ly/Lx).

Next, since the rotation velocity V1 of the conveying ball 201*a* is determined such that the velocity component in the conveying direction is maintained at the reference value V0, the rotation velocity V1 is obtained by an equation: V1=V0/cos θ. Here, since the conveying direction of the conveying ball 201*a* is determined by a velocity difference between the ball drive motors 204*fa* and 204*ra*, it is necessary that a velocity Vf' of conveyance intersecting velocity component V2 with respect to the rotation velocity Vf0 is subtracted from the rotation velocity Vf1 of the ball drive motor 204*fa*. That is, $$Vf1=Vf0-Vf'$$

$$=Vf0-V2/\cos 45°$$

$$=Vf0-(Ly/Lx)\times V0/\cos 45°.$$

Further, it is necessary to add a velocity Vr' of conveyance intersecting velocity component V2 with respect to a rotation velocity Vr0 to a rotation velocity Vr1 of the ball drive motor 204*ra*. That is, $$Vr1=Vr0+Vr'$$

$$=Vr0+V2/\cos 45°$$

$$=Vr0+(Ly/Lx)\times V0/\cos 45°.$$

When a sheet S is deviated in a direction opposite from FIG. 16, it is necessary to add a velocity Vf' of a conveyance intersecting velocity component V2 with respect to the rotation velocity Vf0 to the rotation velocity Vf1 of the ball drive motor 204*fa*. It is necessary to subtract a velocity Vr' of the conveyance intersecting velocity component V2 with respect to the rotation velocity Vr0 from the rotation velocity Vr1 of the ball drive motor 204*ra*. The CPU 500 obtains the rotation velocities Vf1 and Vr1 of the ball drive motors 204*fa* and 204*ra* based on the differential value Ly.

Here, since a velocity vector of the conveying ball 201*a* and velocity vectors of the drive rollers 202*fa* and 202*ra* are different from each other, the deviation rotates and drives while slipping between the conveying ball 201*a* and the drive rollers 202*fa* and 202*ra* (so some slippage between the conveying ball 201*a* and the drive rollers 202*fa* and 202*ra* may occur). Therefore, since the driving efficiency is deteriorated in some cases, in step S207, the CPU 500 corrects the obtained rotation velocities Vf1 and Vr1 of the ball drive motors 204*fa* and 204*ra* with a correction value corresponding to slip between the drive rollers 202*fa* and 202*ra* and the conveying ball 201*a*. Specifically, the obtained rotation velocities Vf1 and Vr1 of the ball drive motors 204*fa* and 204*ra* are multiplied by the correction value. According to this, the skew feeding velocity and the skew feeding angle of the sheet S are brought close to target values. The driving efficiency is influenced by friction coefficient between the conveying ball 201*a* and the drive rollers 202*fa* and 202*ra*, a weight (contact pressures of the conveying ball 201*a* and the drive rollers 202*fa* and 202*ra*) of the follower ball 101*a*, and disposition of the drive rollers 202*fa* and 202*ra*. Therefore, the correction value is set using an experiment value. So a slippage amount or value may be determined by experiment and a corresponding correction value set. To correct a very small difference of the friction coefficient of the drive rollers 202*fa* and 202*ra* and an outer diameter tolerance, the ball drive motors 204*fa* and 204*ra* may have independent correction values. The calculated velocities of the ball drive motors 204*fa* and 204*ra* are set.

Figure 17A:
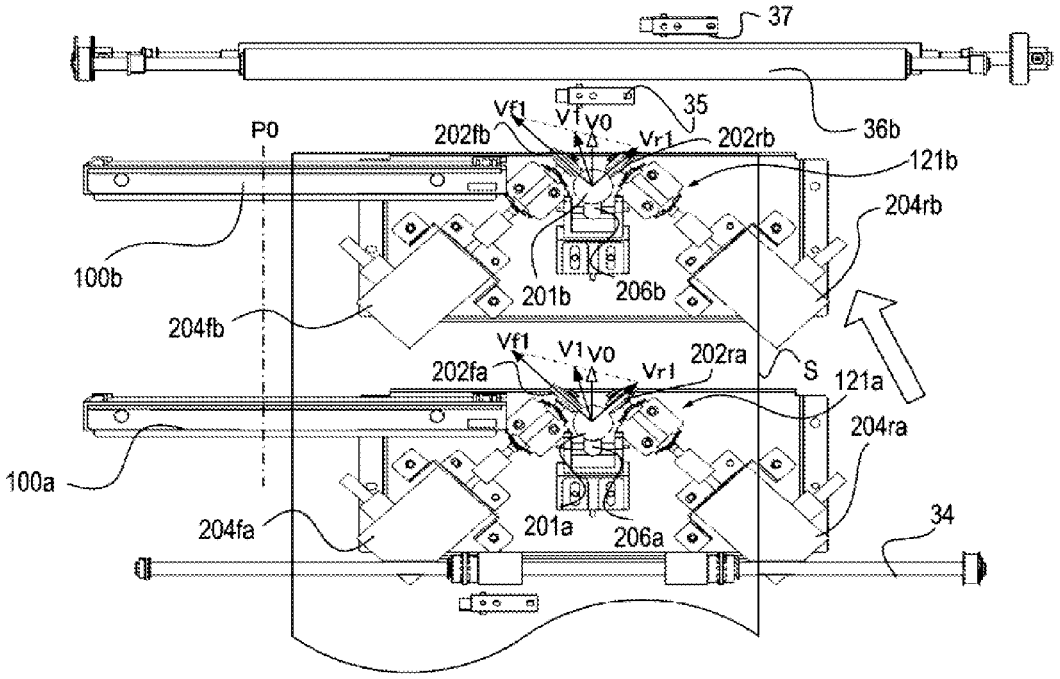
FIG. 17A is a plan view illustrating a state at the time of control of sheet position (attitude) of a sheet position (attitude) correcting portion (when a sheet is deviated rightward with respect to a target position)

A state of position control of a sheet S by the above-described sequence will be described with reference to FIGS. 17 to 19. FIG. 17A illustrates a case where a sheet S is deviated rightward with respect to the target position P0. In this case, velocity vectors of the conveying balls 201*a* and 201*b* are brought to V1, a velocity Vf1 of the ball drive motors 204*fa* and 204*fb* is set faster than a velocity Vr1 of the ball drive motors 204*ra* and 204*rb* so that the sheet S moves in the direction of an outlined arrow. According to this, the sheet S is moved in the direction of the outlined arrow in which the position Py of the side end Se approaches the target position P0.

Figure 17B:
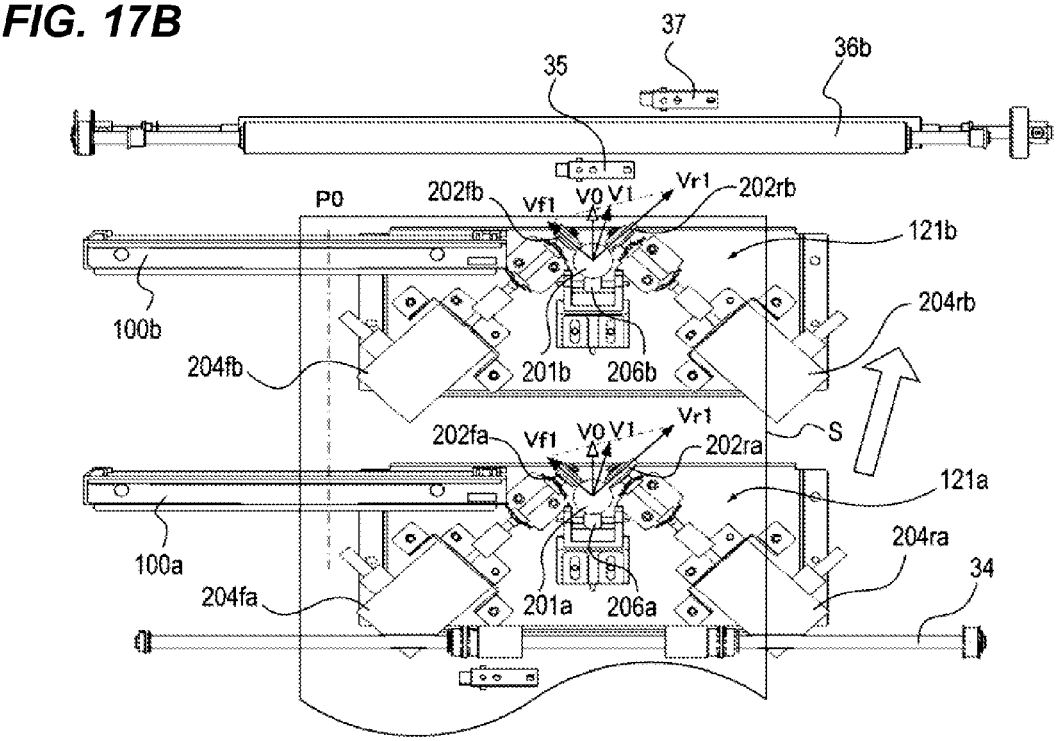
FIG. 17B is a plan view illustrating a state at the time of control of sheet position (attitude) of the sheet position (attitude) correcting portion (when a sheet is deviated leftward with respect to a target position)

FIG. 17B illustrates a case where a sheet S is deviated leftward with respect to the target position P0. In this case, a velocity Vf1 of the ball drive motors 204*fa* and 204*fb* are set slower than the velocity Vr1 of the ball drive motors 204*ra* and 204*rb*, and a sheet S is moved in a direction opposite from that described above. According to this, the sheet S is moved in the direction of the outlined arrow in which the position Py of the side end Se approaches the target position P0.

Figure 18A:
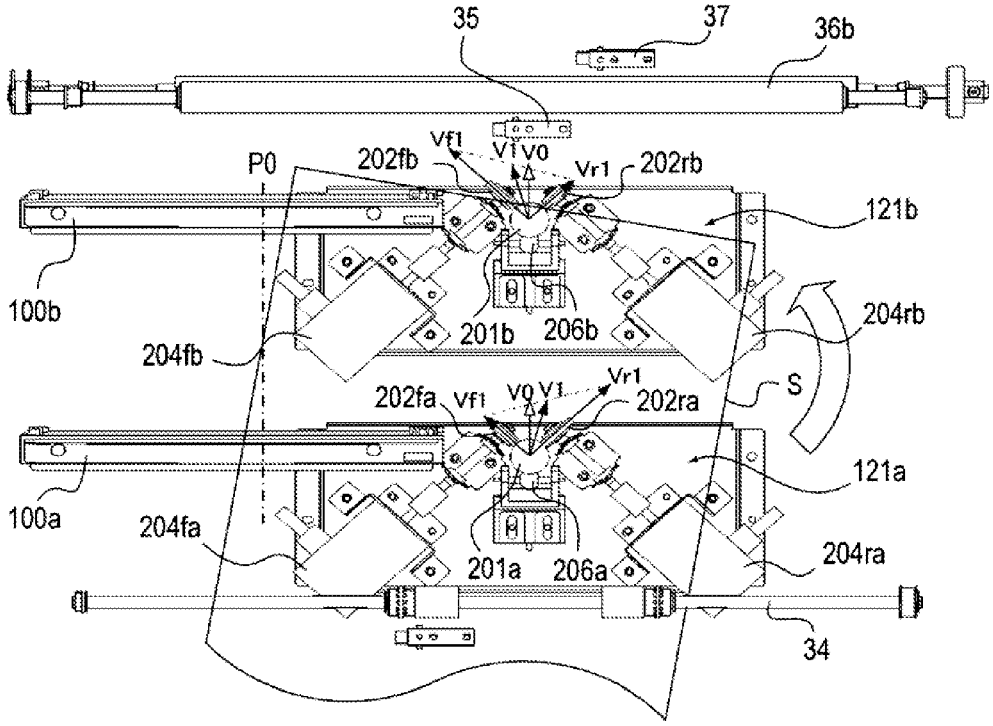
FIG. 18A is a plan view illustrating a state at the time of control of sheet position (attitude) of the sheet position (attitude) correcting portion (when a sheet is skew-fed)

Next, FIG. 18A illustrates a case where a sheet S is skew-fed. In the downstream side CIS 100*b*, since a position Py of a side end Se of a sheet S is deviated rightward with respect to the target position P0, the velocity Vf1 of the downstream side ball drive motor 204*fb* is set faster than the velocity Vr1 of the ball drive motor 204*rb*. On the other hand, in the upstream side CIS 100*a*, since a position Py of a side end Se of a sheet S is deviated leftward with respect to the target position P0, the velocity Vf1 of the upstream side ball drive motor 204*fa* is set slower than the velocity Vr1 of the ball drive motor 204*ra*. According to this, the downstream side conveying ball 201*b* tries to deviate a sheet S leftward, and the upstream side conveying ball 201*a* tries to deviate the sheet S rightward. As a result, the sheet S turns as illustrated with the outlined arrow. Since the constant velocity component in the conveying direction is maintained and the velocity component in the width direction is varied, it is possible to easily turn the sheet S without giving stress to the sheet S. According to this, since even an ultra-thin paper sheet having weak elasticity is not bent, it is possible to carry out precise position control.

Figure 18B:
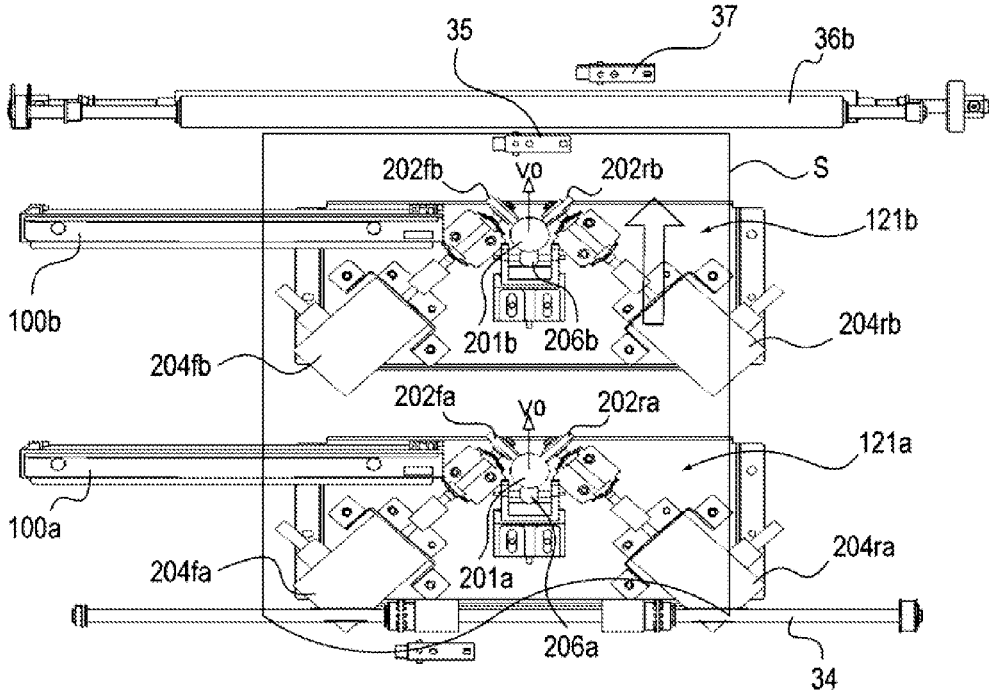
FIG. 18B is a plan view illustrating a state at the time of control of sheet position (attitude) of the sheet position (attitude) correcting portion (when position (attitude) control of a sheet is completed)

FIG. 18B illustrates a state where the position control of a sheet is completed, and when a sheet S is detected by the sheet detecting sensor 35, the CPU 500 sets the skew feeding angle of the ball conveying mechanisms 121*a* and 121*b* to 0°. According to this, it is possible to control the position correction until just before the pair of registration rollers 36*a* and 36*b* which is stable with respect to the conveyance nips the sheet S. Therefore, it is possible to reduce a degree of an influence of conveyance precision of the conveying balls 201*a* and 201*b* exerted on precision of control of the position correction of the sheet S. Since the pair of registration rollers 36*a* and 36*b* does not stop when a sheet S is conveyed, skew feeding which may be caused by colliding motion is not generated.

In the second embodiment, a position of an image and a position of a leading edge (tip end) of a sheet S are aligned by acceleration and deceleration of the pair of registration rollers 36*a* and 36*b*, but the ball conveying mechanisms 121*a* and 121*b* may have such functions and the pair of registration rollers may be omitted. In this case, it is possible to carry out the position correction control until just before an image is formed on the sheet S by the image forming portion 90.

Figure 19A:
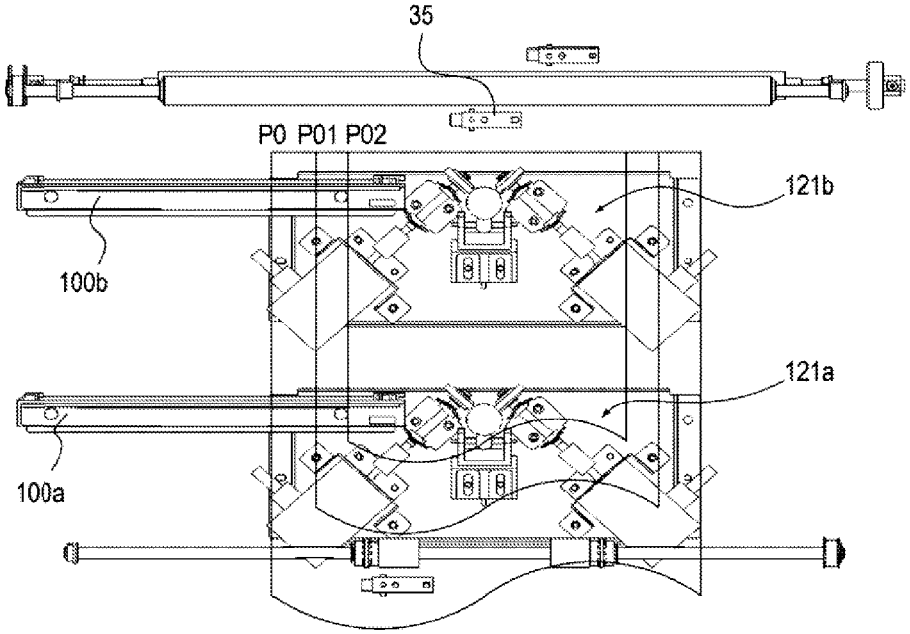
FIG. 19A is a plan view illustrating a state at the time of control of sheet position (attitude) of the sheet position (attitude) correcting portion (illustrating a conveyance position by sheet size)

Next, in the second embodiment, when a sheet S is conveyed on a central line as a reference but when sheets S having different sizes are conveyed as illustrated in FIG. 19A, since the CISs 100*a* and 100*b* are used, the CPU 500 sets target positions P0, P01 and P02 for each of sizes. Sheet size information is input to the CPU 500 by a personal computer through the operation portion 250 or the network 503. Alternatively, the sheet size information is input to the CPU 500 by a sheet size detecting unit (not illustrated) provided in the sheet feeding apparatus 1B.

Meanwhile, when the side of the image forming portion 90 and the side of the registration unit 30 are misaligned with each other, even if the position control is properly carried out, positions of the image and the sheet may be deviated from each other in some cases. When a position of the registration unit 30 itself is adjusted to the image, it is necessary to stop the apparatus. Therefore, the operation becomes complicated.

Figure 19B:
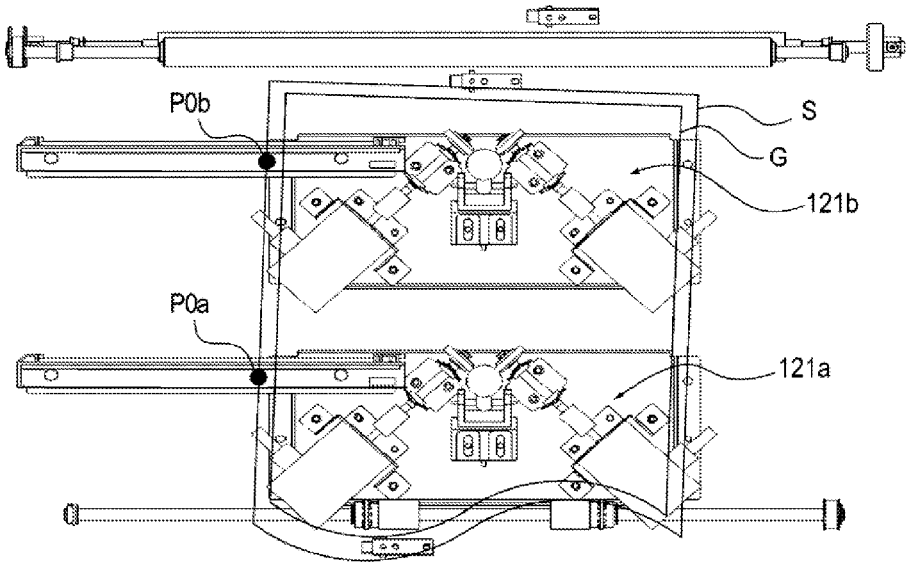
FIG. 19B is a plan view illustrating a state at the time of control of sheet position (attitude) of the sheet position (attitude) correcting portion (illustrating a conveyance position when alignment is corrected)

Hence, in the second embodiment, as illustrated in FIG. 19B, the target positions are set corresponding to the CISs 100*a* and 100*b*, and the target positions P0*a* and P0*b* corresponding to the CISs 100*a* and 100*b* can be changed. If the upstream side target position P0*a* and the downstream side target position P0*b* are deviated and set by the misaligned amount, it is possible to adjust the deviation between a sheet S and an image G. For the adjusting operation, an adjustment value is input by the computer 504 through the operation portion 250 or the network 503. According to this, it is possible to carry out the operation easily. There is also a merit that cost required for introducing an adjusting unit can be suppressed. If a unit which detects a deviation between an image and a sheet is provided in the apparatus, it is possible to adjust automatically.

When a thick sheet is conveyed, upstream side and downstream side target positions P0*a* and P0*b* may be deviated and set. According to this, the sheet is conveyed in its inclined state, and a leading edge (tip end) of a sheet and the secondary transfer inner roller 43 and the secondary transfer outer roller 44 of the secondary transfer portion are not in parallel to each other. Therefore, it is possible to suppress abrupt load variation at the time of transfer nip biting, and a case where a velocity of the intermediate transfer belt 40 is varied and unevenness is generated can be suppressed. It is necessary to incline an image to be transferred according to a sheet. However, since the inclination amount of each sheet is constant, it does not take time for variation of color caused by deviation of dot formation of each color on every sheet of a color image, and for calculation to incline an image. Therefore, productivity is not largely reduced.

In the second embodiment, velocities and angles of the conveying balls 201*a* and 201*b* are changed to the velocities and angles obtained by the above-described equations. Therefore, bending of a sheet S can be suppressed, a case where stress is given to the sheet S can be suppressed, and it is possible to correct skew feeding of a sheet S and to carry out the positioning of a side end Se of a sheet S. It is also possible to correct skew feeding of a sheet S and to carry out the precise positioning of a side end Se of a sheet S with respect to various kinds of materials including a thin paper sheet. Since the differential values Ly are obtained and the skew feeding angles and the skew feeding velocities of the ball conveying mechanisms 121*a* and 121*b* are changed, an amount of overshoot of a sheet S in the width direction is reduced, and it is possible to swiftly bring a side end Se of the sheet S close to the target position P0. Thus, it is possible to enhance the position precision of an image with respect to a sheet S, to convey a sheet fast, and to enhance the productivity.

By maintaining the velocity components of the conveying balls 201*a* and 201*b* in the conveying direction at the reference value V0, it is possible to prevent a distance between sheets S from being deviated, and even when it is desired to reduce the distance between the sheets S to enhance the productivity, it is possible to convey the sheets S stably. It is possible to effectively prevent the bending of a sheet S and a case where both the ball conveying mechanisms 121*a* and 121*b* pull each other. Therefore, high precision position control can be carried out. As the differential value Ly is greater, the velocity component V2 is increased and thus, a side end Se of a sheet S can swiftly be brought close to the target position P0.

Although the present invention is described based on the embodiment, the invention is not limited to this.

Figure 20A:
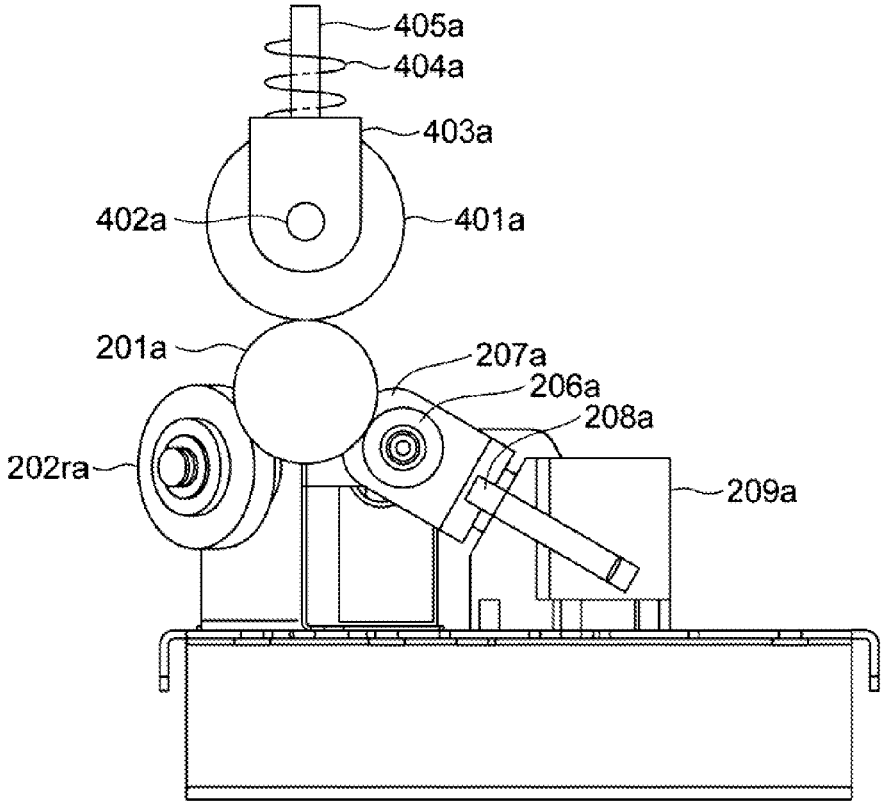
FIG. 20A is a diagram illustrating a modification of the ball conveying mechanism.
Figure 20B:
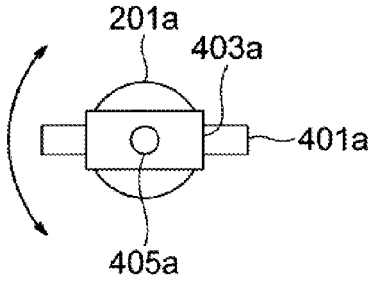
FIG. 20B is a diagram illustrating a modification of the ball conveying mechanism (explanatory diagram of a follower roller).

Although the follower rotating member of each of the ball conveying mechanism is a follower ball, the invention is not limited to this. FIG. 20A illustrates an upstream side ball conveying mechanism, but as illustrated in FIG. 20A, the follower rotating member of the ball conveying mechanism may be a follower roller 401*a*. The follower roller 401*a* is rotatably supported by a roller shaft 402*a*. The roller shaft 402*a* is supported by a holder 403*a*. The follower roller 401*a* is biased against the conveying ball 201*a* by a pressure spring 404*a*. As illustrated in FIG. 20B, the follower roller 401*a* is supported such that the follower roller 401*a* can oscillate around a shaft 405*a* fixed to a holder 403*a*. In FIG. 20, the upstream side ball conveying mechanism is described, but the downstream side ball conveying mechanism may have the same configuration. Although the follower rotating member of the steering mechanism is the follower ball in the first embodiment, the invention is not limited to this. Although it is not illustrated in the drawing, the follower rotating member may have the configuration of the follower roller that is the same as that illustrated in FIG. 20.

In the first and second embodiments, a case where a target position P0 of a side end Se of a sheet S is set constant when the sheet size is the same is described, but the invention is not limited to this. The target position P0 may be changed whenever a job in which the CPU 500 forms an image is changed. According to this, when a sheet S after being discharged is loaded, it becomes easy to visually check a boundary of jobs. Generally, an example in which a discharge roller or a discharge tray is deviated in the width direction intersecting with the conveying direction is known, but even if such a mechanism is not added, the same effect can be obtained. In this case, control to deviate a writing position of image formation according to a moving amount of the target position P0, but since the writing position can be changed whenever a sheet size is changed, it is possible to easily conduct such control. Since sheets S are changed whenever a job is changed, when sheets of the same size are always conveyed to rollers such as fixing rollers or an intermediate transfer belt, it is possible to suppress a case where the rollers or the intermediate transfer belt are worn away (shaved) and surface roughness is deteriorated. That is, by gradually moving the target position P0 for every sheet, a contact position of a sheet side end with respect to the rollers is changed, the durability against the wear (shave) of the rollers can be enhanced. Since the durability against the wear (shave) of the rollers is enhanced, it is possible to suppress a case where a line is formed on a sheet on which an image is formed. Especially when a small size sheet is mainly used, if a sheet larger than this is output, it is possible to effectively suppress a case where a line is formed on the large sheet.

In the first and second embodiments, the present invention applied to the registration unit of the image forming apparatus using the electrophotographic system is described, the invention may be applied to other conveying portion. The invention may be applied to other image forming apparatuses such as an ink-jet image forming apparatus and a thermal transfer image forming apparatus.

In the first and second embodiments, the case where the image forming apparatus includes two conveying portions (steering mechanisms or ball conveying mechanisms) is described, the number of conveying portions is not limited to this. The invention can be applied to a case where the image forming apparatus includes two or more conveying portions. In this case, a side end position detector (contact image sensor) is provided for each conveying portion, and the number of the side end position detectors is the same as the number of conveying portions.

The present invention also provides an image forming apparatus (1) which carries out positioning of a side end of a sheet in a width direction intersecting with a sheet conveying direction while conveying the sheet, and which forms an image on the sheet by an image forming portion (90), the image forming apparatus comprising: a plurality of conveying portions (120*a*, 120*b*) which is disposed along the conveying direction upstream of the image forming portion in the sheet conveying direction, and which can feed sheets on the skew in any direction with respect to the sheet conveying direction; a plurality of side end position detectors (100*a*, 100*b*) which is disposed along the sheet conveying direction corresponding to the conveying portions, respectively, and which respectively detect side end positions of a sheet in the width direction; and a controlling portion (500) which obtains a differential value between the side end position detected by the side end position detector and a target position of the side end of the sheet for each of the conveying portions, and which changes a skew feeding angle and a skew feeding velocity of each conveying portion according to the differential value.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-298431, filed Dec. 28, 2009, which is hereby incorporated by reference herein in its entirety.

What is claimed is:

1. An image forming apparatus arranged to carry out position adjustment, of a side edge of a sheet, in a width direction intersecting with a sheet conveying direction, and to correct skew feeding of the sheet while conveying the sheet, and wherein the image forming apparatus comprises an image forming portion arranged to form an image on the sheet, the image forming apparatus further comprising:

a first conveying portion positioned upstream of the image forming portion in the sheet conveying direction, wherein the first conveying portion is operable to vary its conveying angle and conveying velocity to adjust the skew of the conveyed sheet in a plurality of directions with respect to the sheet conveying direction;

a second conveying portion positioned downstream of the first conveying portion in the sheet conveying direction, wherein the second conveying portion is operable to vary its conveying angle and conveying velocity to adjust the skew of the conveyed sheet in a plurality of directions with respect to the sheet conveying direction;

a first side edge position detector in a position corresponding to the first conveying portion and arranged to detect a side edge position of the sheet in the width direction;

a second side edge position detector in a position corresponding to the second conveying portion and arranged to detect the side edge position of the sheet in the width direction; and a controlling portion arranged to obtain a differential value between the side edge position detected by the first and second side edge position detectors and a target position of the side edge of the sheet for each of the first and second conveying portions, and arranged to control the conveying angle and the conveying velocity of each conveying portion according to the differential value.

2. The image forming apparatus according to claim 1, wherein the controlling portion is arranged to control a velocity component of the conveying velocity, of each of the first and second conveying portion, in the width direction such that it increases as the differential value increases and to control the velocity component of the feeding conveying velocity of each of the first and second conveying portion in the sheet conveying direction such that it remains constant.

3. The image forming apparatus according to claim 1, wherein the controlling portion is arranged to set the target position according to input sheet size information.

4. The image forming apparatus according to claim 1, wherein the controlling portion is arranged to set a target position corresponding to each side edge position detector and wherein the target positions corresponding to the first and second side edge position detectors can be changed independently.

5. The image forming apparatus according to claim 1, further comprising a sheet detector, disposed between the image forming portion and the second conveying portion, for detecting a sheet, wherein when a sheet is detected by the sheet detector, the controlling portion is arranged to set a conveying angle of each conveying portion to 0°.

6. The image forming apparatus according to claim 1, wherein each of the first and second conveying portions includes:

a spherical conveyance rotating member arranged to be rotatable in any direction;

a follower rotating member arranged to press the conveyance rotating member and follow the rotation of the conveyance rotating member, such that the conveyed sheet is nipped between the conveyance rotating member and the follower rotating member;

two drive rollers arranged to press the conveyance rotating member and to rotate the conveyance rotating member; and two driving portions each arranged to drive one of the drive rollers to rotate, wherein the controlling portion is arranged to control the conveying angle and conveying velocity of the spherical rotating conveyance member by controlling the driving portions.

7. The image forming apparatus according to claim 6, wherein the controlling portion is arranged to obtain a rotation velocity of each of the driving portions based on the differential value, and to correct the rotation velocity of each of the driving portions using a correction value which corresponds to a slippage amount between the drive roller and the conveyance rotating member.

8. The image forming apparatus according to claim 1, wherein each of the first and second conveying portions includes:

a steering roller arranged to be rotatable about a roller axis and further arranged to be rotatable about an axis extending perpendicular to the roller axis;

a follower rotating member arranged to press the steering member roller and follow the rotation of the steering member roller such that the conveyed sheet is nipped between the steering roller and the follower rotating member;

a drive means arranged to drive the steering roller to rotate about the roller axis;

a steering drive means arranged to drive the steering roller to rotate about the axis extending perpendicular to the roller axis;

wherein the controlling portion is arranged to control the conveying velocity of the steering roller by controlling the drive means and to control the conveying angle of the steering member roller by controlling the steering drive means.

* * * * *